US011974596B2

(12) United States Patent
Dishion et al.

(10) Patent No.: US 11,974,596 B2
(45) Date of Patent: May 7, 2024

(54) SYSTEMS AND METHODS FOR AN AUTOMATIC FILLING MACHINE

(71) Applicant: Coastal Counting & Industrial Scale Company, Inc., Santa Paula, CA (US)

(72) Inventors: John Dishion, Santa Paula, CA (US); Jason Satnick, Santa Paula, CA (US); Roberto Santos, Santa Paula, CA (US); Hasala Senevirathne, Santa Paula, CA (US); Christopher Dawley, Santa Paula, CA (US); Bryan Chandler, Santa Paula, CA (US); Sergio Rivera, Santa Paula, CA (US)

(73) Assignee: Coastal Counting & Industrial Scale Company, Inc., Santa Paula, CA (US)

( * ) Notice: Subject to any disclaimer, the term of this patent is extended or adjusted under 35 U.S.C. 154(b) by 60 days.

(21) Appl. No.: 17/986,730

(22) Filed: Nov. 14, 2022

(65) Prior Publication Data

US 2023/0148654 A1 May 18, 2023

Related U.S. Application Data

(60) Provisional application No. 63/278,592, filed on Nov. 12, 2021.

(51) Int. Cl.

| | |
|---|---|
| ***A24C 5/34*** | (2006.01) |
| ***A24C 5/02*** | (2006.01) |
| ***A24C 5/39*** | (2006.01) |

(52) U.S. Cl.

CPC ..... *A24C 5/3424* (2013.01); *A24C 5/02* (2013.01); *A24C 5/393* (2013.01); *A24C 5/395* (2013.01); *A24C 5/397* (2013.01); *A24C 5/399* (2013.01)

(58) Field of Classification Search

None

See application file for complete search history.

(56) References Cited

U.S. PATENT DOCUMENTS

| | | | | |
|---|---|---|---|---|
| 4,541,826 | A * | 9/1985 | Warner | A24D 3/0225 493/47 |
| 2021/0022388 | A1* | 1/2021 | Sullivan | A24C 5/02 |
| 2021/0392944 | A1* | 12/2021 | Kustal | A24C 5/02 |

* cited by examiner

*Primary Examiner* — Phu H Nguyen

(74) *Attorney, Agent, or Firm* — Holland & Hart LLP

(57) ABSTRACT

A rolling system including a measuring station. The measuring station includes a hopper for receiving a smokable product, a vibratory bowl for receiving the smokable product from the hopper, a weigh bowl for receiving the smokable product from the vibratory bowl, a weigh module attached to the weigh bowl for measuring the smokable product in the weigh bowl, and a puck defining a plurality of cavities for receiving the smokable product therein. Each cavity of the plurality of cavities is configured to receive a predetermined amount of smokable product within a predetermined tolerance of the predetermined amount.

21 Claims, 39 Drawing Sheets

SYSTEMS AND METHODS FOR AN AUTOMATIC FILLING MACHINE

CROSS REFERENCE TO RELATED APPLICATIONS

This application claims the benefit of and priority to U.S. Provisional Patent Application No. 63/278,592, filed Nov. 12, 2021, which is hereby incorporated by reference in its entirety.

TECHNICAL FIELD

The present invention is in the technical field of weighing and filling systems and more particularly to an accurate net weight-based filling system for producing prerolls that are compliant, consistent, repeatable, and scalable for automatic cone filling.

BACKGROUND

Currently available systems for weighing products and filling containers do not fill the container with an accurately measured amount of the substance. For example, in the smokable products industry, prerolled smokable products are typically hand filled and rolled. The person manually filling and rolling the product typically measures an amount of the smokable product on a weighing device and manually fills a preroll with the weighed smokable product. The weighing device may be of low quality and may not be accurate and smokable product may be lost in the transfer from the weighing device into the preroll. As such, an unknown amount of the smokable product may be filled in the preroll.

Additionally, federal, state, and local regulations may require that the amount of smokable substance within the preroll be within a predetermined tolerance. Specifically, at least some regulations require that the prerolled smokable product have an actual weight that is within the predetermined tolerance of a predetermined weight. More specifically, at least some regulations require that the actual weight of the prerolled smokable product be within ±3% or the predetermined weight. For example, some regulations require that the actual weight of the prerolled smokable product be with ±3% of 0.5 grams (g). Manually weighing and filling of prerolled smokable product may result in loses of up to 20% of the smokable product because the roller may not accurately weigh the product, resulting in the prerolled smokable product being discarded.

Currently available systems for automatically filling and weighing the prerolled smokable products use a volume method that is unreliable and not useful for many critical applications. Specifically, the volume method typically does not accurately weigh the product such that the actual weight of the prerolled smokable products is within the predetermined tolerance of the predetermined weight. More specifically, the volume method, and other weighing methods, have difficultly accurately weighing smokable products with speed and accuracy.

Therefore, there is a need for a weighing and filling system that overcomes the above referenced limitations by providing an accurate net weight based rolling system producing prerolls that are compliant, consistent, repeatable, and scalable for automatic cone filling.

SUMMARY

An aspect of the present disclosure relates to a weighing and filling system including a measuring station. The measuring station includes a hopper for receiving a smokable product, a vibratory bowl for receiving the smokable product from the hopper, a weigh bowl for receiving the smokable product from the vibratory bowl, a weigh module attached to the weigh bowl for measuring the smokable product in the weigh bowl, and a puck defining a plurality of cavities for receiving the smokable product therein. Each cavity of the plurality of cavities is configured to receive a predetermined amount of smokable product within a predetermined tolerance of the predetermined amount.

Another aspect of the present disclosure relates to a method of manufacturing a plurality of prerolled cones containing a smokable product using a measuring station and a tamping station. The measuring station includes a hopper, a vibratory bowl, a weigh bowl, a weigh module, and a puck. The tamping station includes an upper tube assembly including a plurality of tight tubes for containing the plurality of prerolled cones, a lower tube assembly including a plurality of loose tubes for containing the plurality of prerolled cones, and a seating platform. The method includes receiving the smokable product into the vibratory bowl. The method also includes metering the smokable product from the vibratory bowl to the weigh bowl. The method further includes measuring the smokable product in the weigh bowl using the weigh modules. The method also includes determining that the smokable product in the weigh bowl is within a predetermined tolerance of a predetermined amount of smokable product. The method further includes moving the smokable product from the weigh bowl to a plurality of cavities within the puck. The method also includes transferring the puck to the tamping station. The method further includes stacking the upper tube assembly on the lower tube assembly and the puck on the upper tube assembly. The method also includes vibrating the upper tube assembly, the lower tube assembly, and the puck with the seating platform to tamp the smokable product in the plurality of cavities into the plurality of prerolled cones.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label.

Figure 1:
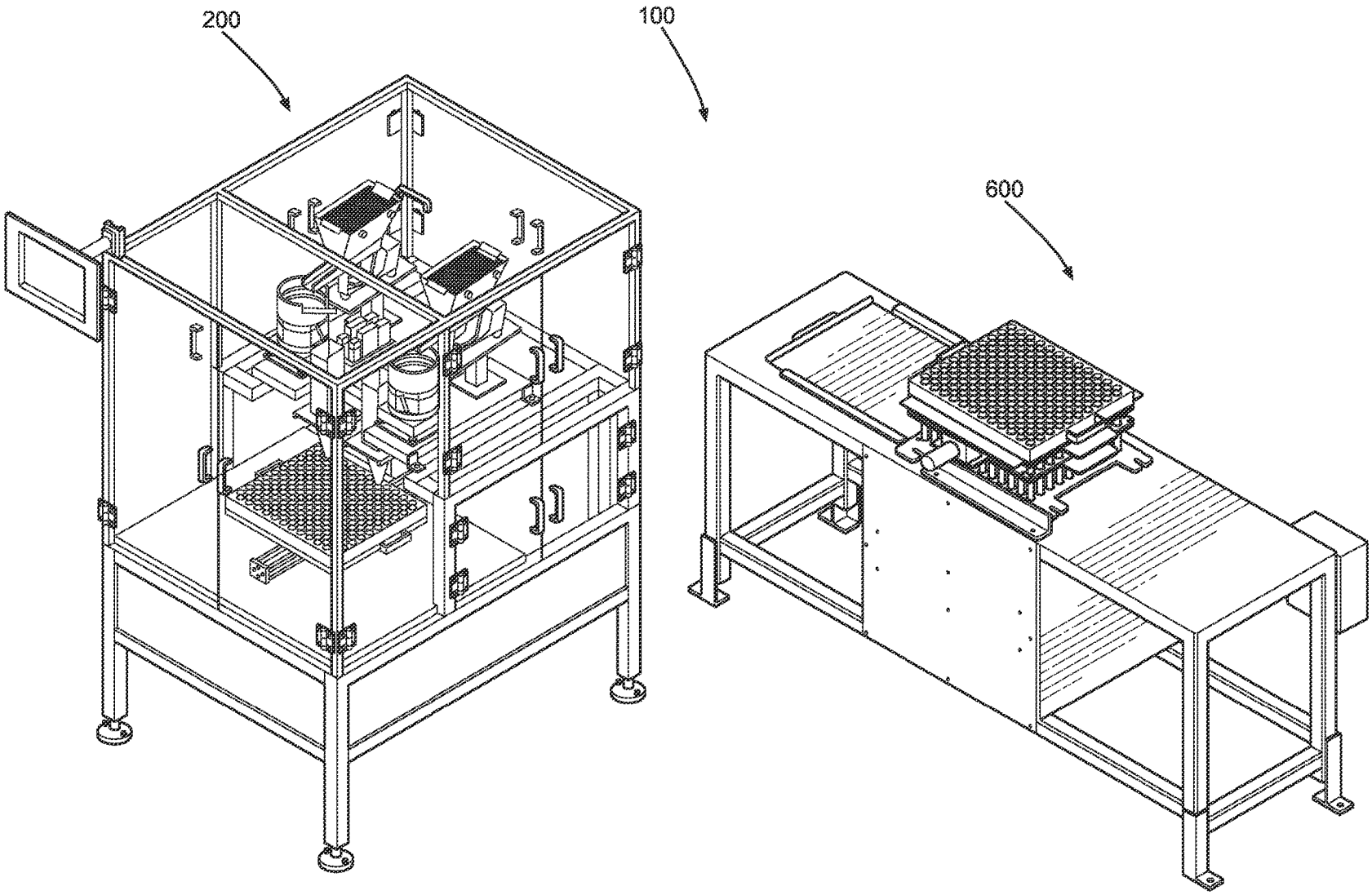
FIG. 1 illustrates a perspective view of an accurate net weight based rolling system for producing prerolls that are compliant, consistent, repeatable, and scalable for automatic cone filling in accordance with aspects of the current disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Figure 2:
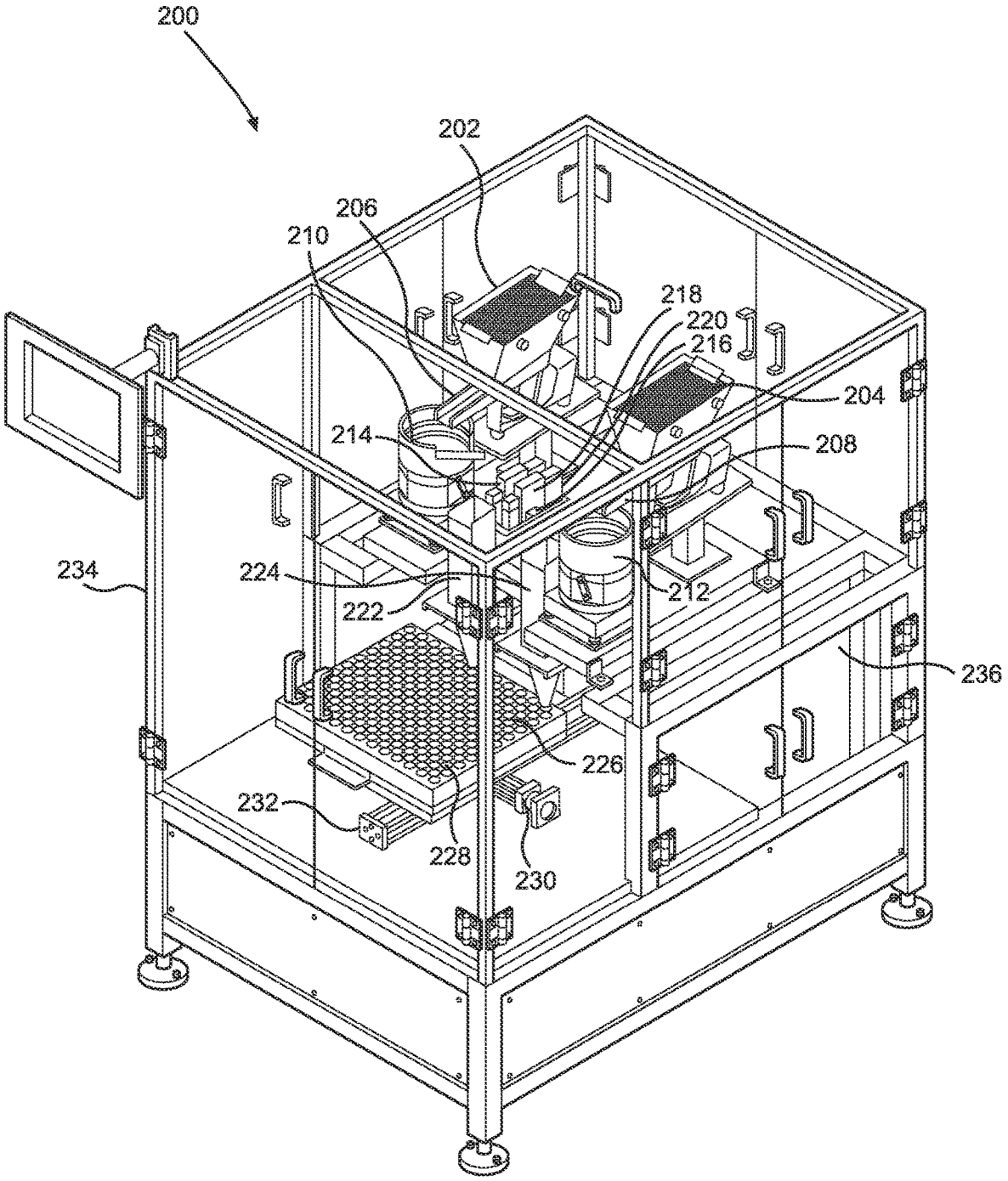
FIG. 2 illustrates a perspective view of the measuring station shown in FIG. 1 in accordance with aspects of the current disclosure.
Figure 3:
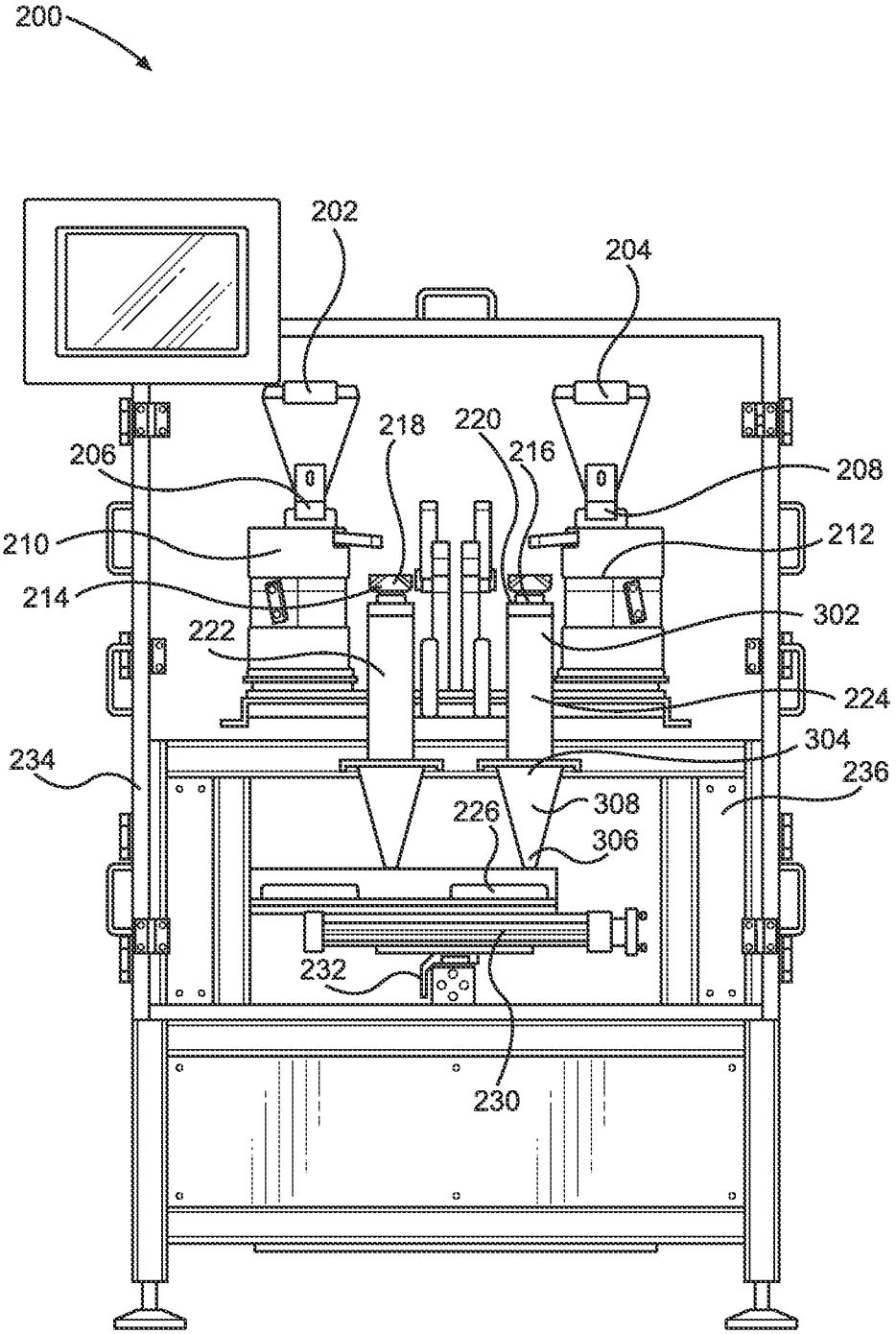
FIG. 3 illustrates a front view of the measuring station shown in FIG. 1 in accordance with aspects of the current disclosure.
Figure 4:
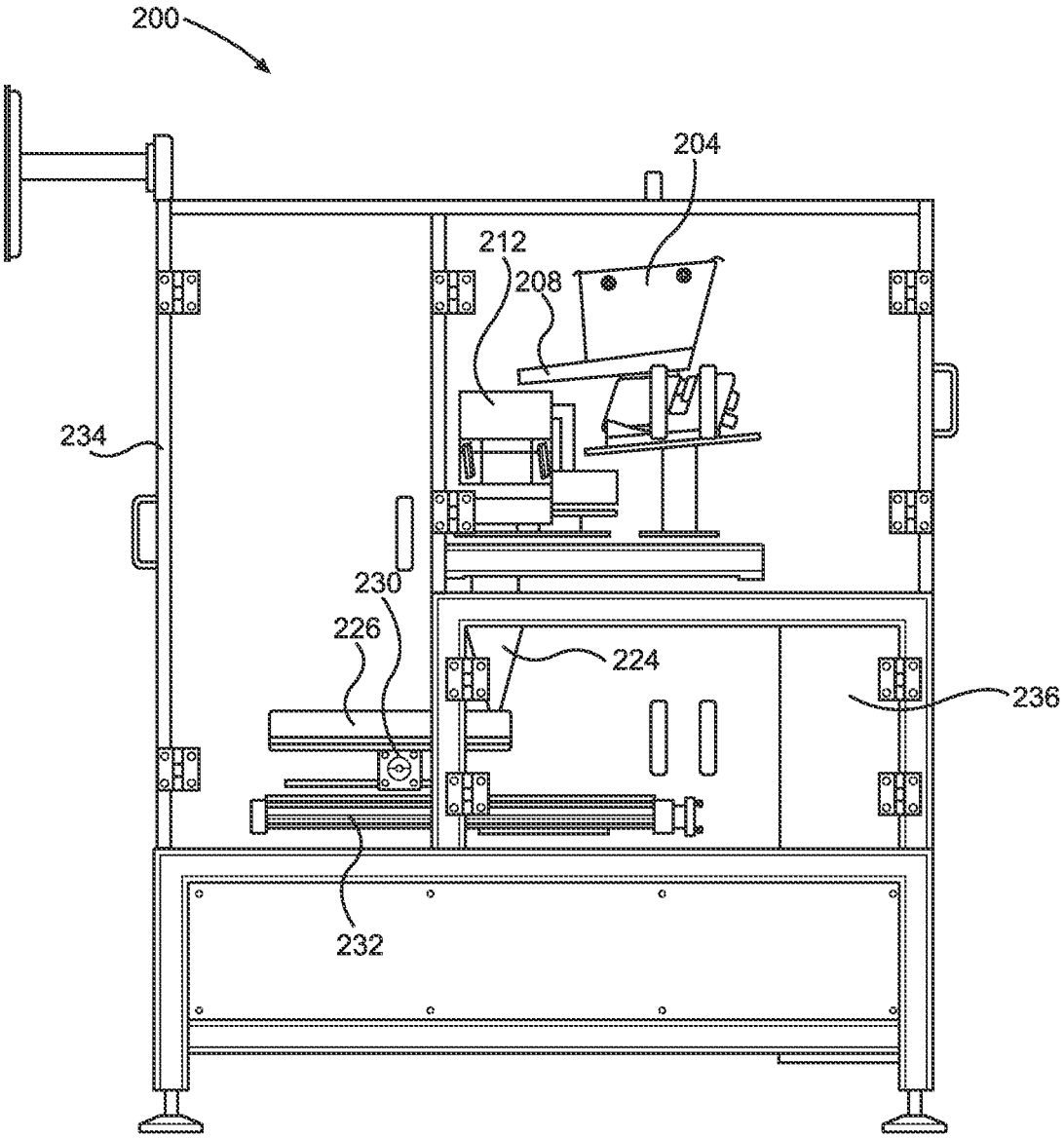
FIG. 4 illustrates a side view of the measuring station shown in FIG. 1 in accordance with aspects of the current disclosure.
Figure 5:
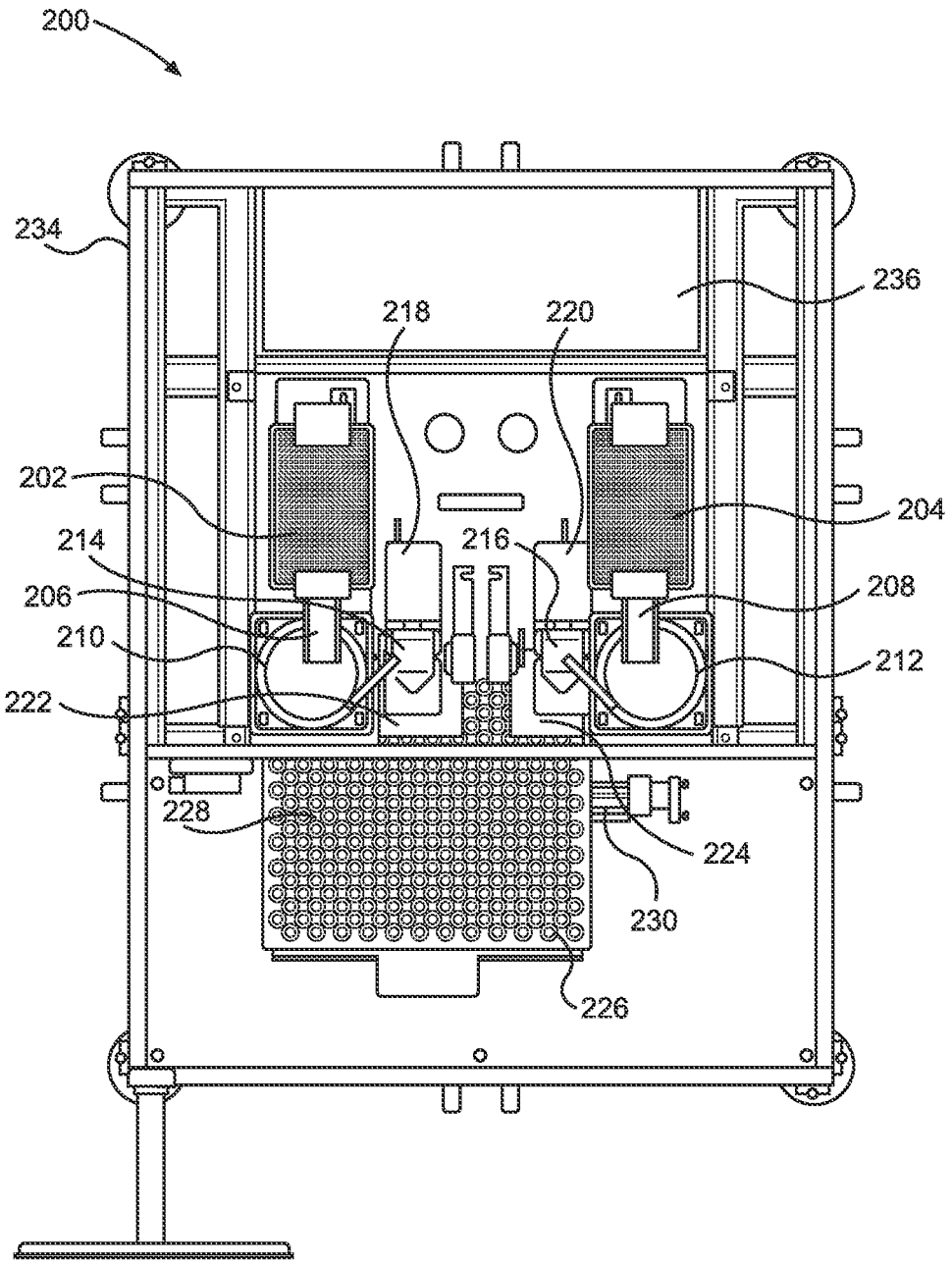
FIG. 5 illustrates a top view of the measuring station shown in FIG. 1 in accordance with aspects of the current disclosure.
Figure 6:
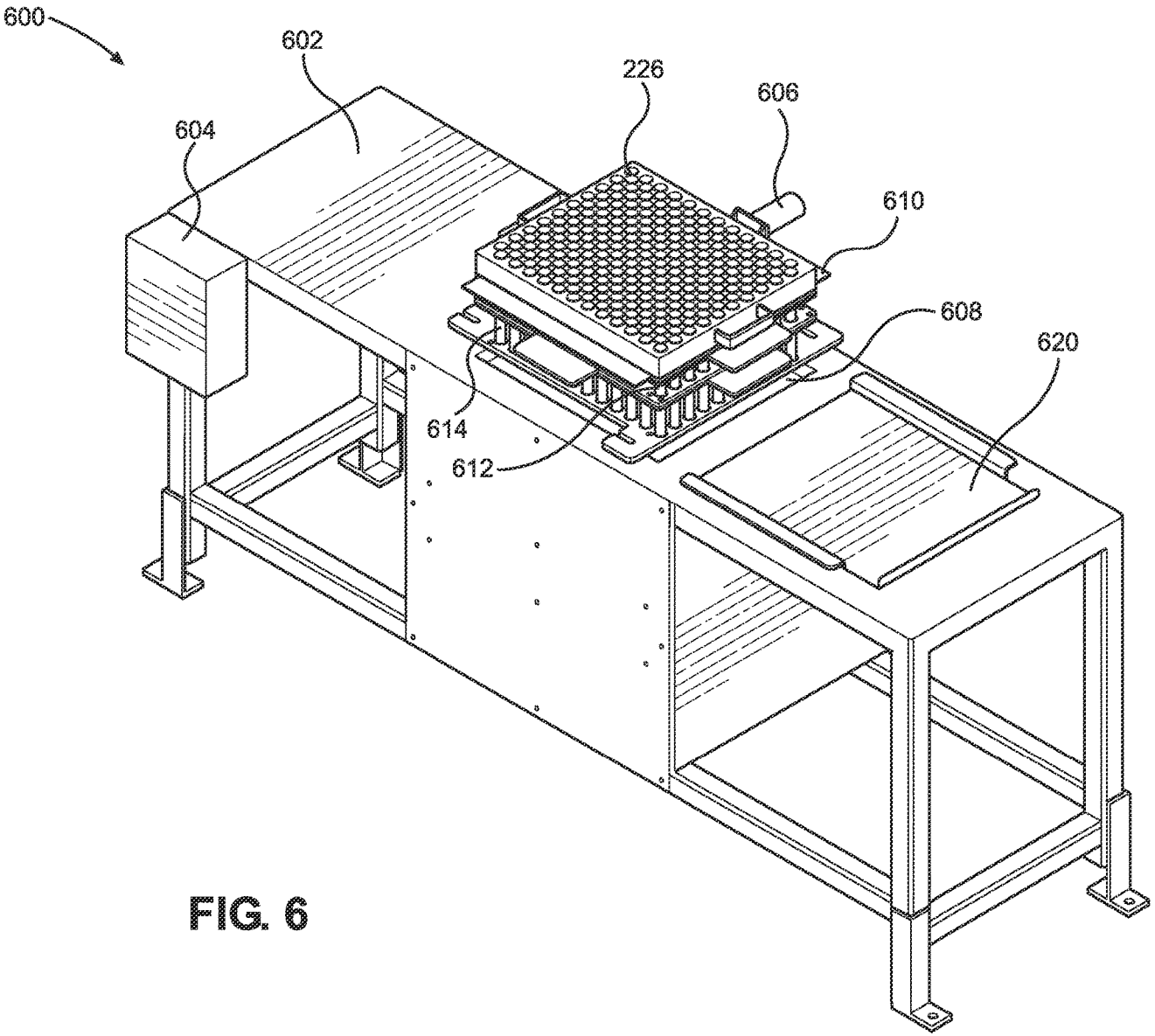
FIG. 6 illustrates a perspective view of the tamping station shown in FIG. 1 in accordance with aspects of the current disclosure.
Figure 7:
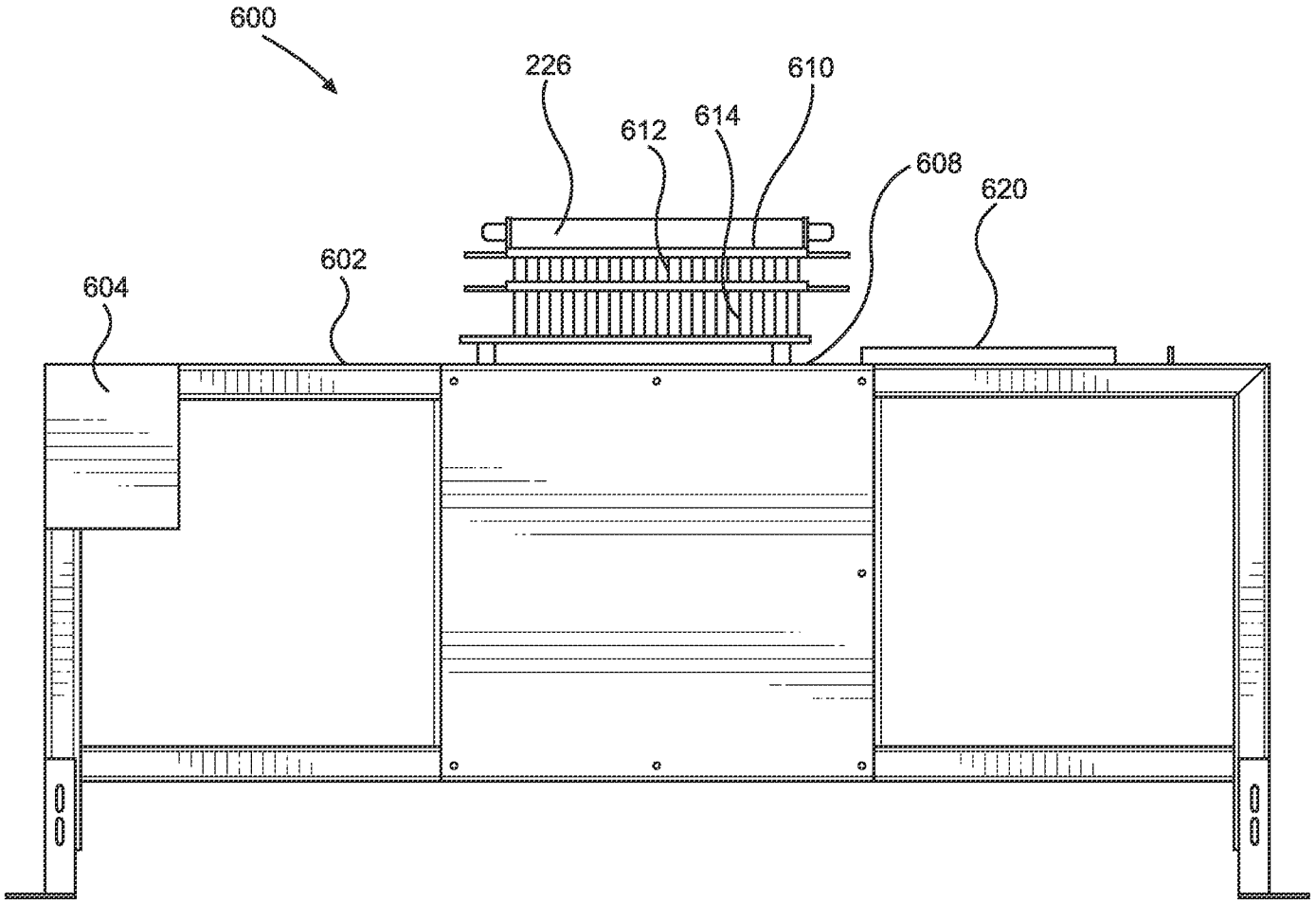
FIG. 7 illustrates a front view of the tamping station shown in FIG. 1 in accordance with aspects of the current disclosure.
Figure 8:
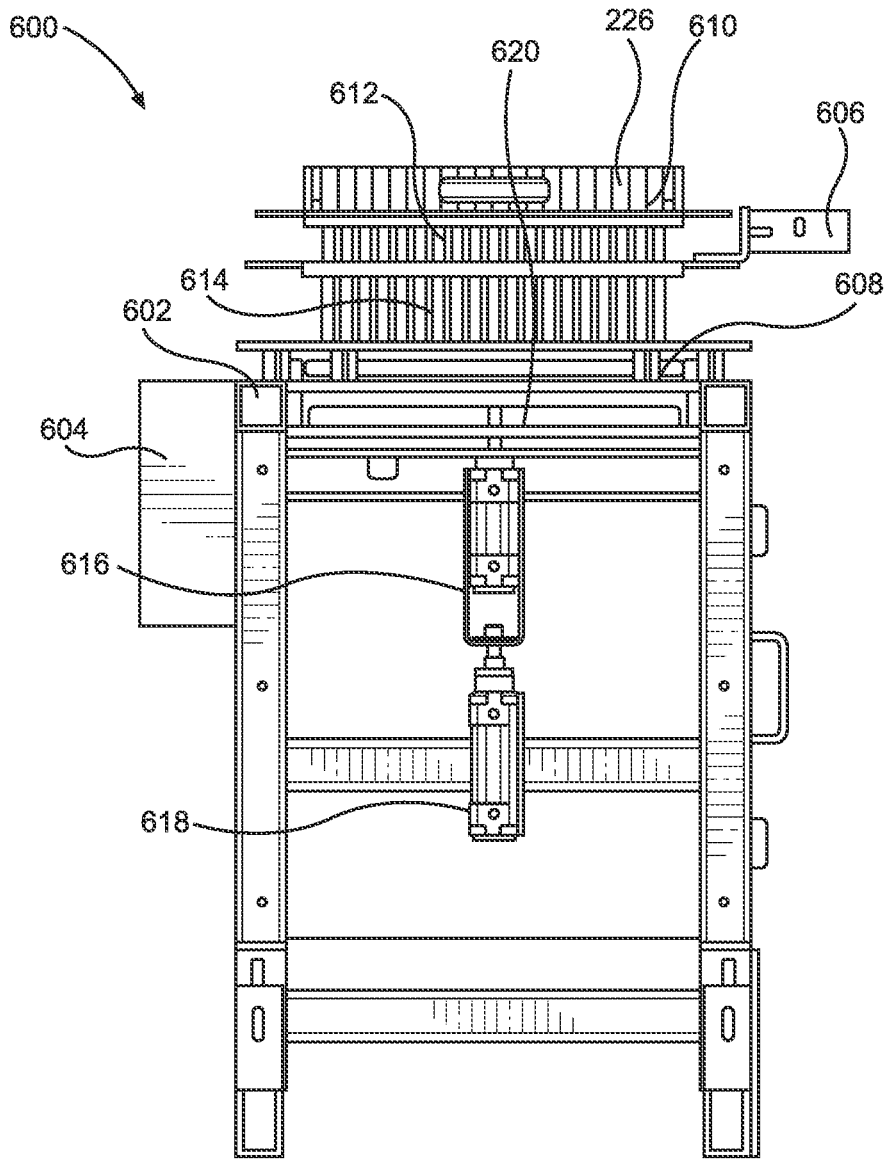
FIG. 8 illustrates a side view of the tamping station shown in FIG. 1 in accordance with aspects of the current disclosure.
Figure 9:
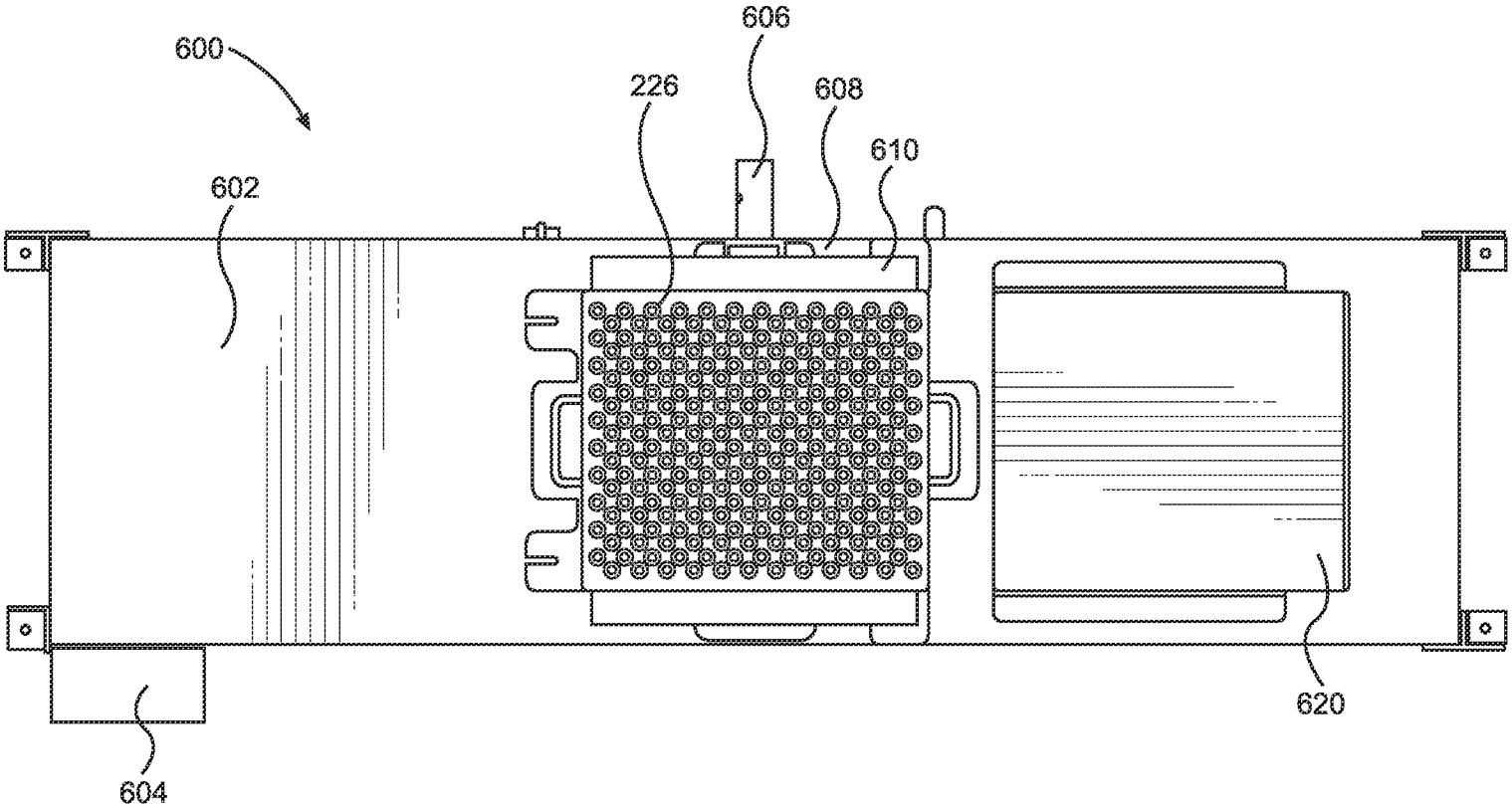
FIG. 9 illustrates a top view of the tamping station shown in FIG. 1 in accordance with aspects of the current disclosure.

FIG. 1 illustrates a perspective view of an accurate net weight based rolling system 100 for producing prerolls that are compliant, consistent, repeatable, and scalable for automatic cone filling, according to one embodiment of the present invention. The accurate net weight based rolling system 100 includes a measuring station 200 and a tamping station 600. FIG. 2 illustrates a perspective view of the measuring station 200 shown in FIG. 1. FIG. 3 illustrates a front view of the measuring station 200 shown in FIG. 1. FIG. 4 illustrates a side view of the measuring station 200 shown in FIG. 1. FIG. 5 illustrates a top view of the measuring station 200 shown in FIG. 1. FIG. 6 illustrates a perspective view of the tamping station 600 shown in FIG. 1. FIG. 7 illustrates a front view of the tamping station 600 shown in FIG. 1. FIG. 8 illustrates a side view of the tamping station 600 shown in FIG. 1. FIG. 9 illustrates a top view of the tamping station 600 shown in FIG. 1.

As shown in FIG. 2, the measuring station 200 includes at least one hopper 202 and 204. In the illustrated embodiment, the measuring station 200 includes two hoppers 202 and 204 for receiving the smokable product and feeding the smokable product to the rest of the measuring station 200. In alternative embodiments, the measuring station 200 may include any number of hoppers 202 and 204 that enables the measuring station 200 to operate as described herein. The measuring station 200 also includes at least one linear feeder pan 206 and 208 that is connected to the hoppers 202 and 204 such that the hoppers 202 and 204 feed the smokable product to the linear feeder pans 206 and 208. In the illustrated embodiment, the measuring station 200 includes two linear feeder pans 206 and 208 for receiving the smokable product from the hoppers 202 and 204 and feeding the smokable product to the rest of the measuring station 200. In alternative embodiments, the measuring station 200 may include any number of linear feeder pans 206 and 208 that enables the measuring station 200 to operate as described herein.

The measuring station 200 further includes at least one vibratory bowl 210 and 212 that is connected to the linear feeder pans 206 and 208 such that the linear feeder pans 206 and 208 feed the smokable product to the vibratory bowls 210 and 212. In the illustrated embodiment, the measuring station 200 includes two vibratory bowls 210 and 212 for receiving the smokable product from the linear feeder pans 206 and 208 and feeding the smokable product to the rest of the measuring station 200. In alternative embodiments, the measuring station 200 may include any number of vibratory bowls 210 and 212 that enables the measuring station 200 to operate as described herein. The measuring station 200 also includes at least one weigh bucket scoop 214 and 216 for receiving the smokable product from the vibratory bowls 210 and 212. In the illustrated embodiment, the measuring station 200 includes two weigh bucket scoops 214 and 216 for receiving the smokable product from the vibratory bowls 210 and 212 and feeding the smokable product to the rest of the measuring station 200. In alternative embodiments, the measuring station 200 may include any number of weigh bucket scoops 214 and 216 that enables the measuring station 200 to operate as described herein.

The measuring station 200 further includes at least one weigh modules 218 and 220 is attached to the weigh bucket scoops 214 and 216 for weighing the smokable product in the weigh bucket scoops 214 and 216. In the illustrated embodiment, the measuring station 200 includes two weigh modules 218 and 220 for weighing the smokable product in the weigh bucket scoops 214 and 216. In alternative embodiments, the measuring station 200 may include any number of weigh modules 218 and 220 that enables the measuring station 200 to operate as described herein. The measuring station 200 also includes at least one feeder 222 and 224 for receiving the smokable product from the weigh bucket scoops 214 and 216. In the illustrated embodiment, the measuring station 200 includes two feeders 222 and 224 for receiving the smokable product from the weigh bucket scoops 214 and 216 and feeding the smokable product to the rest of the measuring station 200. In alternative embodiments, the measuring station 200 may include any number of feeders 222 and 224 that enables the measuring station 200 to operate as described herein.

The measuring station 200 further includes a puck 226 defining a plurality of cavities 228 for receiving the smokable product from the feeders 222 and 224. In the illustrated embodiment, the measuring station 200 includes one puck 226 including 240 cavities for receiving the smokable product from the feeders 222 and 224. In alternative embodiments, the measuring station 200 may include any number of pucks 226 including any number of cavities 228 that enables the measuring station 200 to operate as described herein. The measuring station 200 further includes at least one X-axis orienter 230 and at least one Y-axis orienter 232 that are connected to the puck 226 for positioning the cavities 228 below the feeders 222 and 224 to ensure that the smokable product is loaded into a cavity 228 without losing smokable product. The puck 226 is removably attached to a system chassis 234 of the measuring station 200 such that the puck 226 may be moved to the tamping station 600 without losing smokable product. The measuring station 200 also includes a main control console 236 is also attached to the system chassis 234.

During operation of the measuring station 200, smokable product is loaded into the hoppers 202 and 204 and the hoppers 202 and 204 feed the smokable product into the linear feeder pans 206 and 208. As discussed in greater detail below, the hoppers 202 and 204 and the linear feeder pans 206 and 208 are designed to feed the smokable product to the measuring station 200 in consistent manner. The linear feeder pans 206 and 208 then feed the smokable product to the vibratory bowls 210 and 212, which meters the smokable product to the weigh bucket scoops 214 and 216 in a controlled and predictable manner such that each weigh bucket scoop 214 and 216 is filled with a precise, predetermined amount of smokable product. The weigh modules 218 and 220 then precisely weigh the smokable product in each weigh bucket scoop 214 and 216 to ensure that each cavity 228 is filled with the predetermined amount of smokable product. If the smokable product in the weigh bucket scoops 214 and 216 is within a predetermined tolerance of the predetermined amount of smokable product, the weigh bucket scoops 214 and 216 feed the smokable product into the feeders 222 and 224 which feed the smokable product into the cavities 228. The X-axis orienter 230 and the Y-axis orienter 232 move the puck 226 such that empty cavities 228 are positioned below the feeders 222 and 224 and the process is repeated until all of the cavities 228 are filled. The puck 226 is then moved to the tamping station 600 for packing as described below. Additionally, as described below, each portion of the measuring station 200 has been precisely designed to feed a consistent amount of smokable product through the measuring station 200 such that each cavity 228 contains the predetermined amount of smokable product within the predetermined tolerance.

As shown in FIGS. 6-9, the tamping station 600 includes a table 602, an air nozzle 604, a pneumatic piston 606, a seating platform 608, a first thin layer of low friction UHMW 610, an upper tube assembly 612, a lower tube assembly 614, a short air cylinder 616, a long air cylinder 618, and a receiving tray 620. The table 602 provides structural support for the tamping station 600 and the air nozzle 604, the pneumatic piston 606, the seating platform 608, the first thin layer of low friction UHMW 610, the upper tube assembly 612, the lower tube assembly 614, the short air cylinder 616, the long air cylinder 618, and the receiving tray 620 are supported by or attached to the table 602.

The air nozzle 604 is attached to the table 602 and is configured to seat cones into the upper tube assembly 612 such that the cones receive the smokable product while minimizing loss of the smokable product. Specifically, the preassembled cones are manually placed in the upper tube assembly 612 and the air nozzle 604 is used to manually seat the cone in the upper tube assembly 612 such that each cone fits snuggly in the upper tube assembly 612. In the illustrated embodiment, the air nozzle 602 includes a flat brush design that allows the operator to swiftly seat the cones into position for tamping. In the illustrated embodiment, the air nozzle 604 is configured to disperse air evenly into two cones simultaneously. In alternative embodiments, the air nozzle 604 may be configured to disperse air evenly into any number of cones simultaneously.

The seating platform 608 is attached to the table 602 and configured to tamp and fill the cones. The seating platform 608 is attached to the short air cylinder 616 and the long air cylinder 618. The seating platform 608 supports and tamps the cones to form an even pack while seated in the loose cones. The seating platform 608 has two positions, "up", or "start", and "down", or "tamp". The long air cylinder 618 moves the seating platform 608 from the filling position (tight tubes) to the tamping position (loose tubes) and back up to be transferred onto the lower tube assembly 614. The short air cylinder 616 is equipped with specialty software and hardware to control the short air cylinder's 616 amplitude and stroke for a desired tamping action and bounces the cones to compaction according to customer preferences.

The pneumatic piston 606 is configured to vibrate the upper tube assembly 612, the lower tube assembly 614, and the puck 226. The vibrations caused by the pneumatic piston 606 is used to settle the smokable product into the cones and assist in the tamping process. The receiving tray 620 allows the operator to move the packed cones away from the upper tube assembly 612 and the lower tube assembly 614 for twisting and packaging.

During operations, the cones are preassembled and placed in the upper tube assembly 612 and seated into the upper tube assembly 612 using the air nozzle 604. The puck 226 is filled with smokable product as described above. The first thin layer of low friction UHMW 610 is attached to the puck 226 such that the smokable product remains in the cavities 228. The puck 226 and the first thin layer of low friction UHMW 610 are stacked onto the upper tube assembly 612 and the lower tube assembly 614 as shown in FIGS. 6-9. The seating platform is in the state position and the first thin layer of low friction UHMW 610 is removed to enable the smokable product to fall into the cones. The upper tube assembly 612, the lower tube assembly 614, and the puck 226 are vibrated by the pneumatic piston 606 to settle the smokable product in the cones. The puck 226 is removed and returned to the measuring station 200. The seating platform 608 is lowered to tamping position by the long air cylinder 618. The cones descend from the upper tube assembly 612 to the loose, frictionless lower tube assembly 614 and are continuously vibrated. The short air cylinder 616 has software and hardware that control amplitude and stroke for a tamping action and bounces the cones to compaction. The upper tube assembly 612 is removed to expose the filled, tamped cones. The precisely filled, tamped cones are then slid onto the receiving tray 620 with no loss of product and are slightly elevated to expose the cones for ease of access for removal and/or end twisting.

Figure 10:
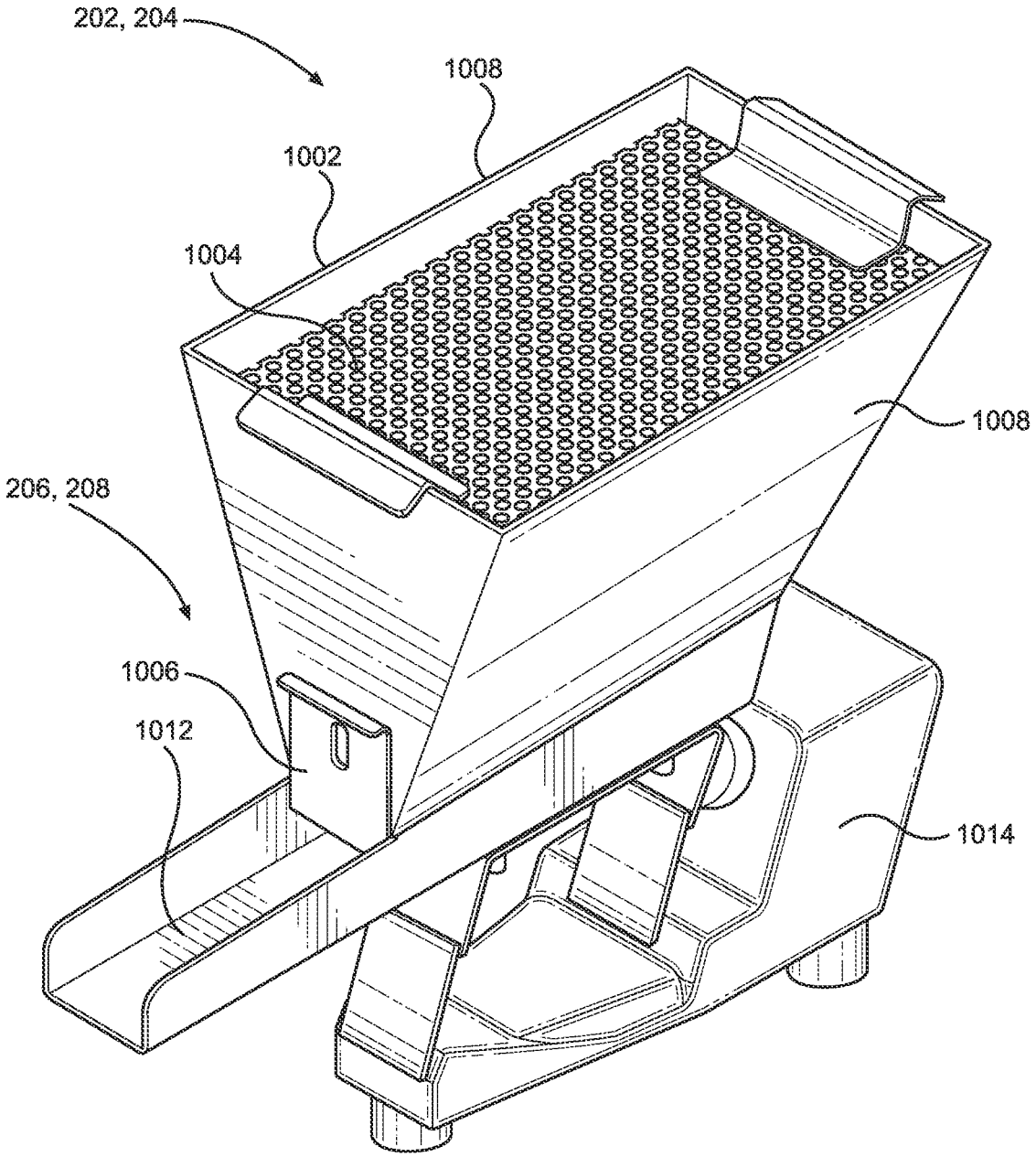
FIG. 10 is a perspective view of the hoppers and the linear feeder pans in accordance with aspects of the current disclosure.
Figure 11:
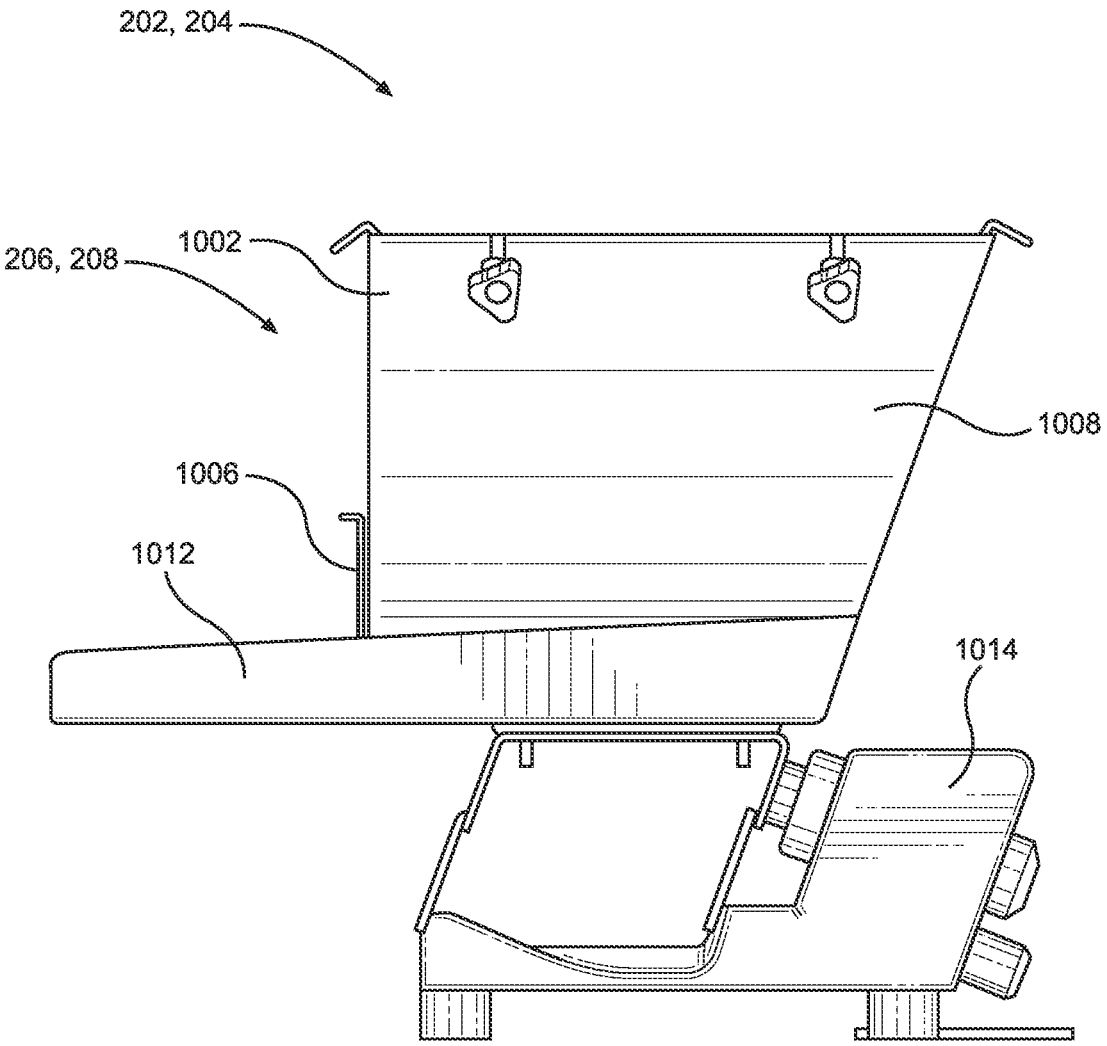
FIG. 11 is a schematic side view of the hoppers and the linear feeder pans in accordance with aspects of the current disclosure.
Figure 12:
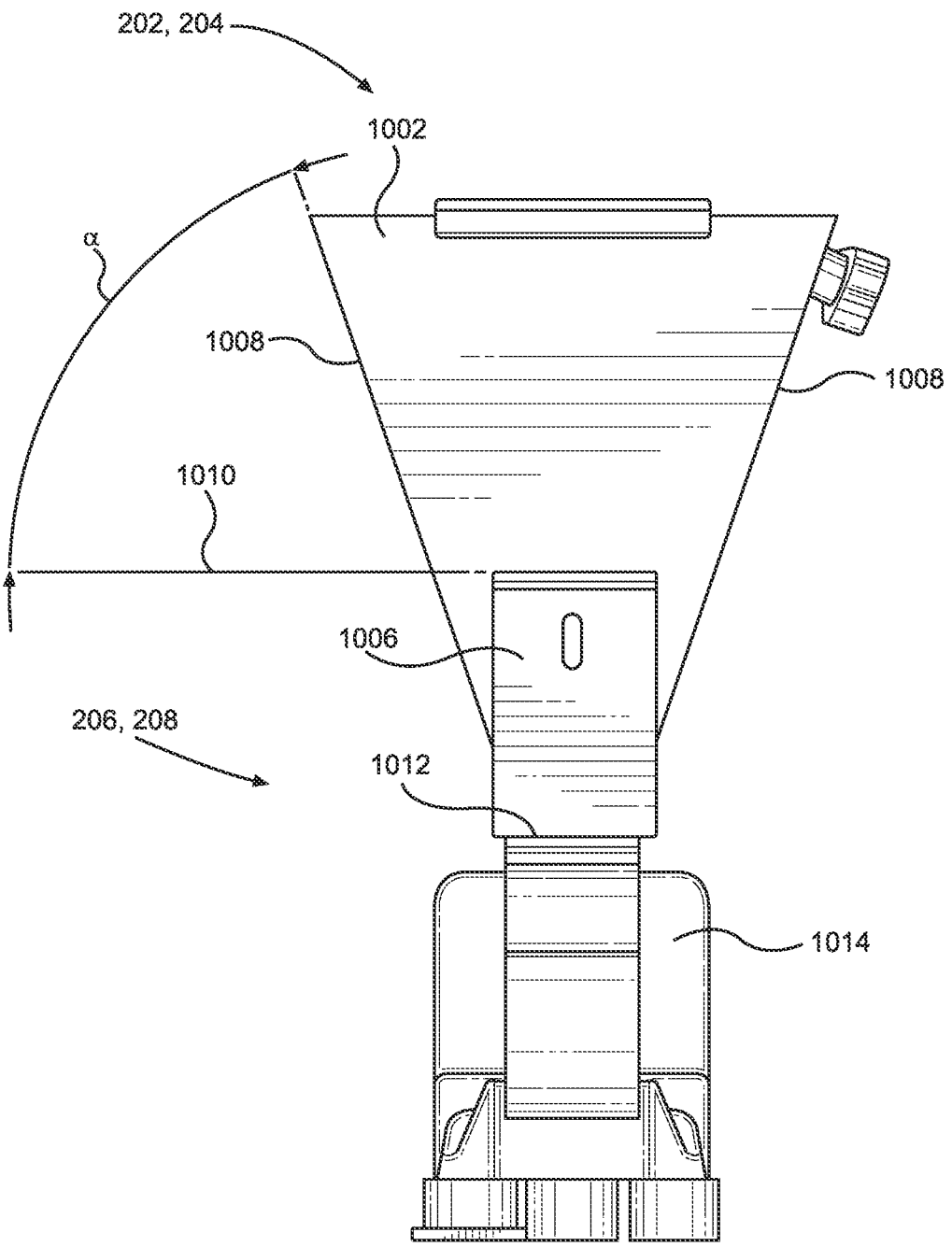
FIG. 12 is a schematic front view of the hoppers and the linear feeder pans in accordance with aspects of the current disclosure.
Figure 13:
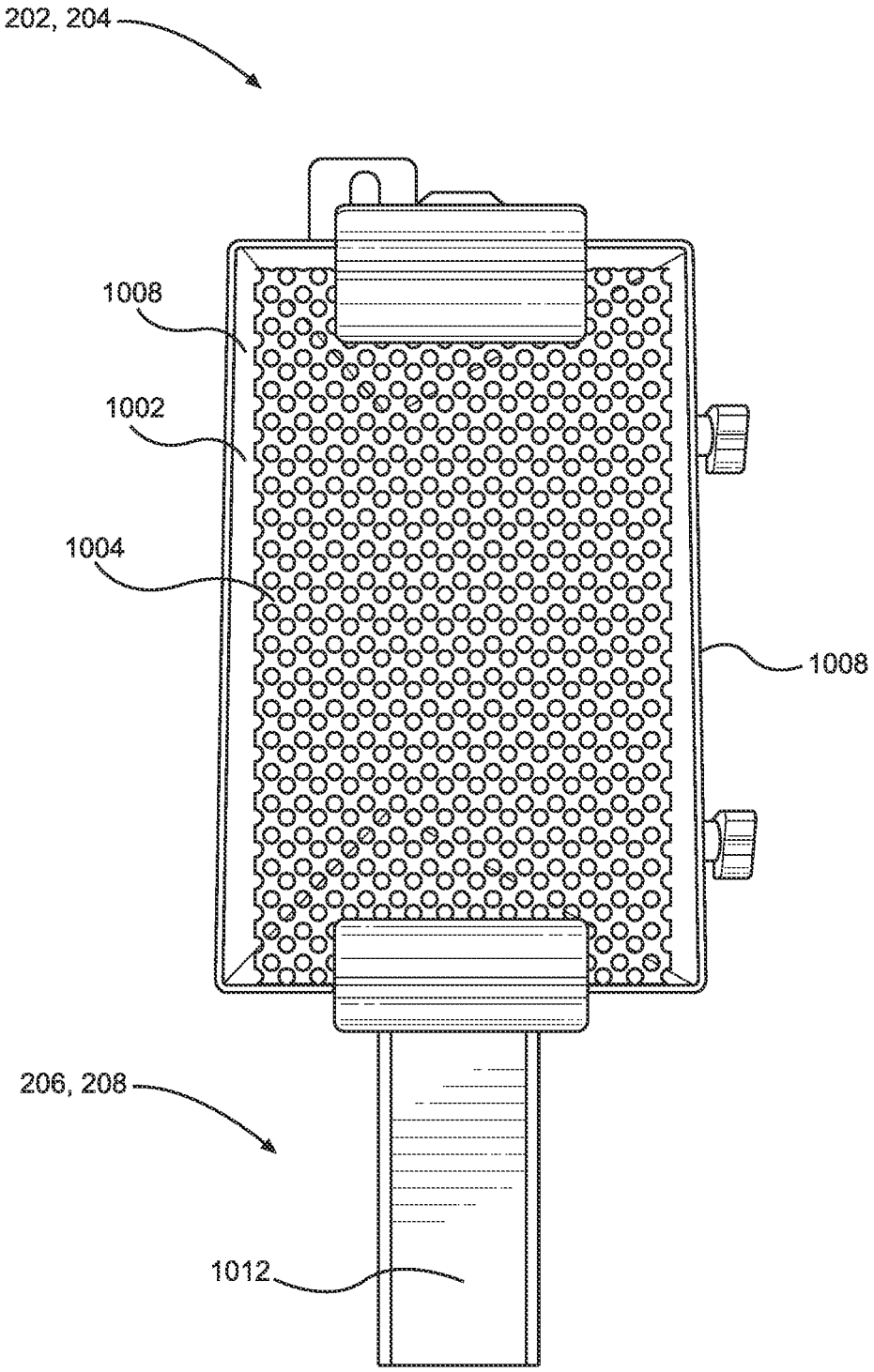
FIG. 13 is a schematic top view of the hoppers and the linear feeder pans in accordance with aspects of the current disclosure.

FIG. 10 is a perspective view of the hoppers 202 and 204 and the linear feeder pans 206 and 208. FIG. 11 is a schematic side view of the hoppers 202 and 204 and the linear feeder pans 206 and 208. FIG. 12 is a schematic front view of the hoppers 202 and 204 and the linear feeder pans 206 and 208. FIG. 13 is a schematic top view of the hoppers 202 and 204 and the linear feeder pans 206 and 208.

As shown in FIGS. 10-13, the hoppers 202 and 204 include a V-shaped container 1002 including a screen 1004 and a gate 1006. The screen 1004 has a predetermined mesh size that ensures that the smokable product is small enough to fit into the cavities 228 and the cones. More specifically, the screen 1004 is used to filter out inconsistencies in the product such as clumps. The container 1002 is sized and shaped to ensure that the smokable product is consistently fed to the linear feeder pans 206 and 208. Specifically, as shown in FIG. 12, the container 1002 has sides 1008 that are arranged at an angle $\alpha$ relative to the horizontal 1010. In the illustrated embodiment, the angle $\alpha$ is about 70° to about 75° or about 71.0111°. The angle $\alpha$ is configured to consistently feed the smokable product to the linear feeder pans 206 and 208. The gate 1006 is configured to open and close to feed the smokable product to the linear feeder pans 206 and 208. The angle of the V-shaped container 1002 allows the product to flow consistently. Too steep or too shallow of an angle may cause product to clog.

The linear feeder pans 206 and 208 are configured to transfer smokable product from the V-shaped container 1002 to the vibratory bowls 210 and 212 with minimal noise. The linear feeder pans 206 and 208 include a sensor (not shown) that activates the linear feeder pans 206 and 208 when the smokable product is low in the vibratory bowls 210 and 212. The linear feeder pans 206 and 208 include a sloped channel 1012 that is attached to the V-shaped container 1002 and a vibratory feeder 1014 configured to vibrate the V-shaped container 1002 and the sloped channel 1012 to move the smokable product. Specifically, vibration of the vibratory feeders 1014 vibrates the V-shaped container 1002, the screen 1004, and the sloped channel 1012 to move the smokable product through the screen 1004, the V-shaped container 1002, and the sloped channel 1012. As discussed herein, the main control console 236 includes a plurality of controls that variably and adjustably control the hoppers 202 and 204 and the linear feeder pans 206 and 208.

Specifically, the main control console 236 includes controllers that include variable amplitude and frequency control that is adjustable. Because the consistency of the smokable product varies greatly, the amplitude and frequency of the vibrations of the vibratory feeders 1014 may be varied to ensure the consistency of the smokable product fed to the measuring station 200 remains constant. That is, the vibratory feeders 1014 may be mechanically and electronically adjusted for product consistency. In the illustrated embodiment, the vibratory feeders 1014 are powered by digitally adjustable RC 24 vdc variable amplitude and frequency control devices. The RC control devices and the angles $\alpha$ of the sides 1008 of the V-shaped container 1002 are designed and configured to ensure that the consistency of the smokable product that is fed to the measuring station 200 remains constant.

Figure 14:
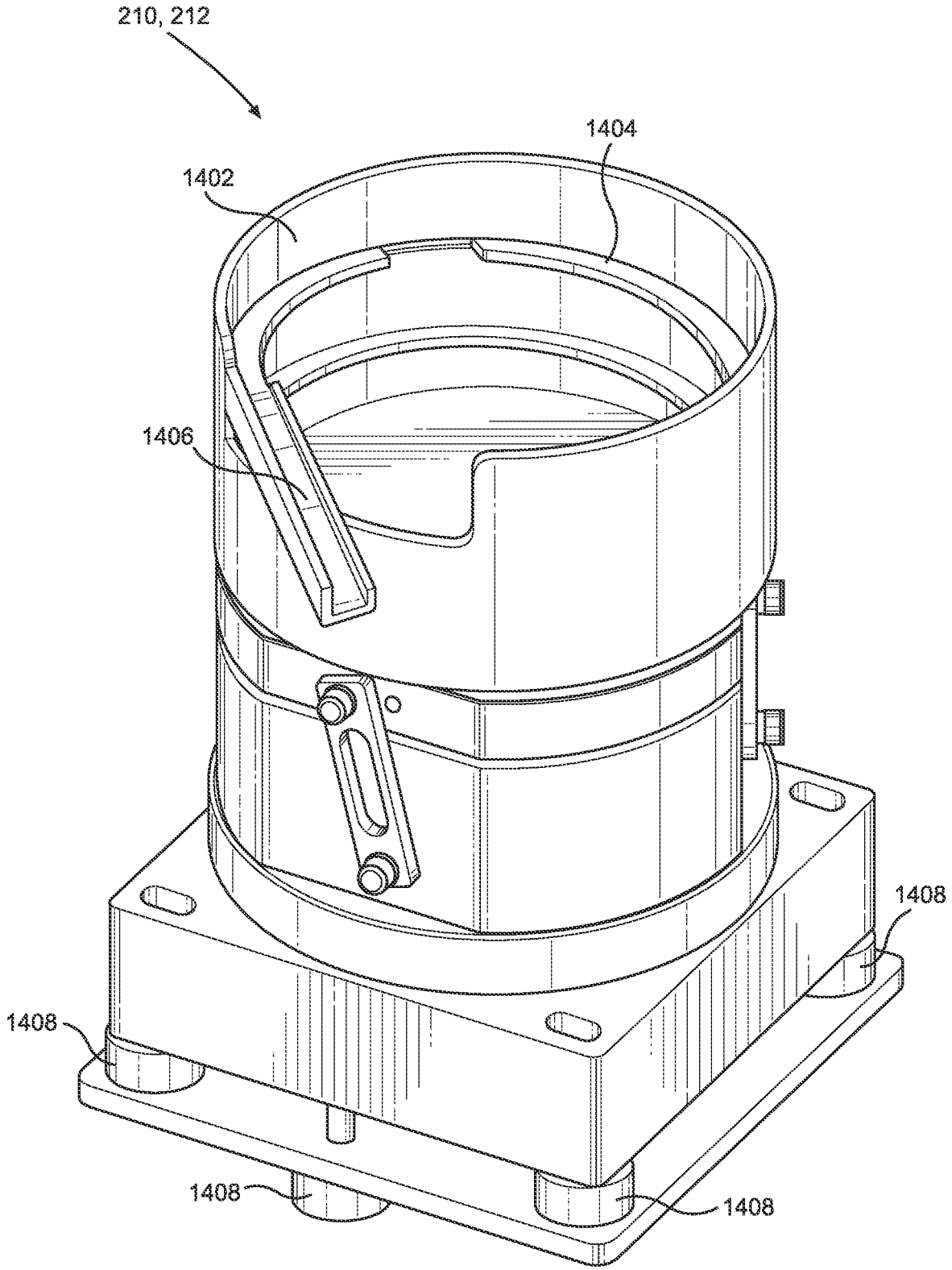
FIG. 14 is a perspective view of the vibratory bowls in accordance with aspects of the current disclosure.
Figure 15:
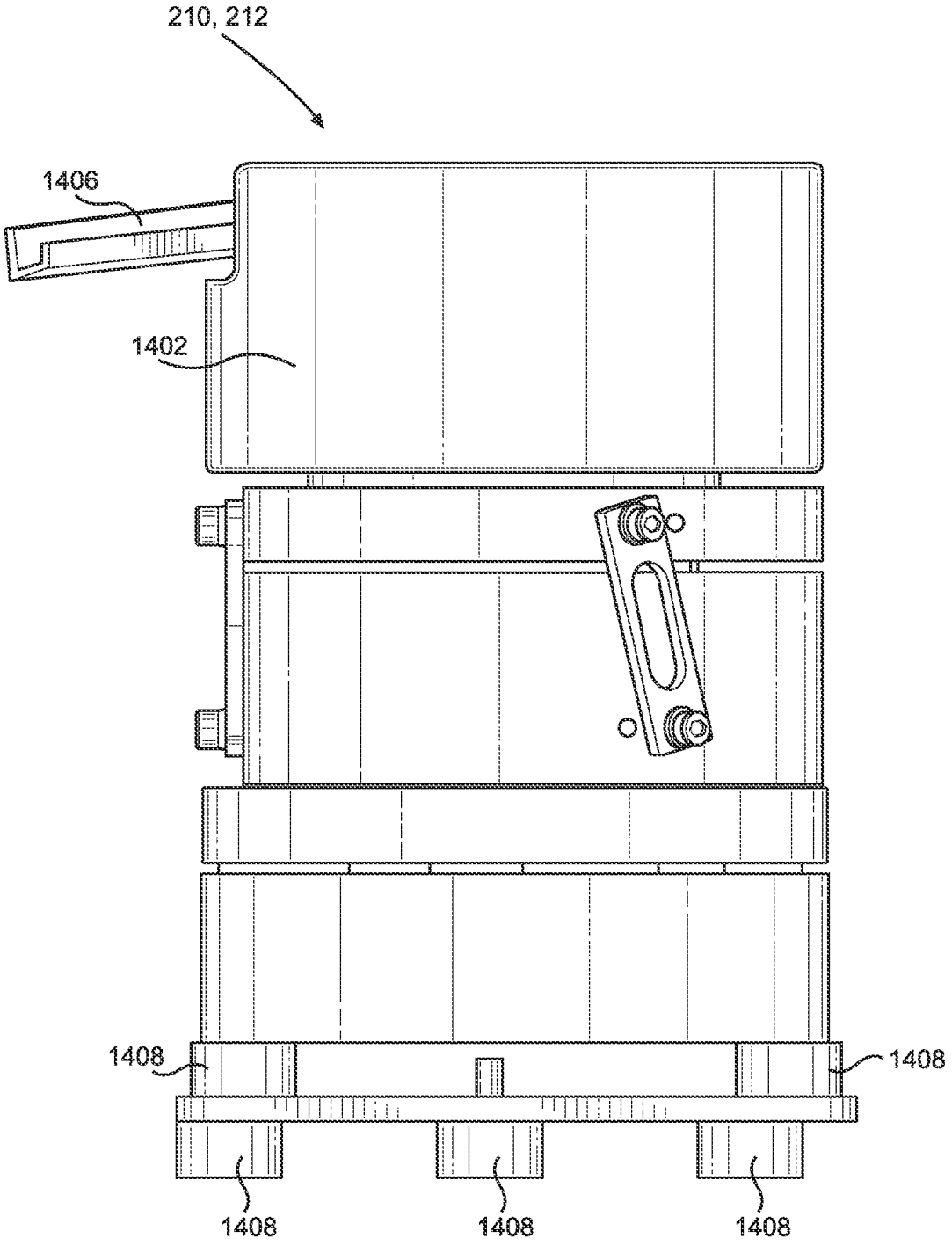
FIG. 15 is a schematic side view of the vibratory bowls in accordance with aspects of the current disclosure.
Figure 16:
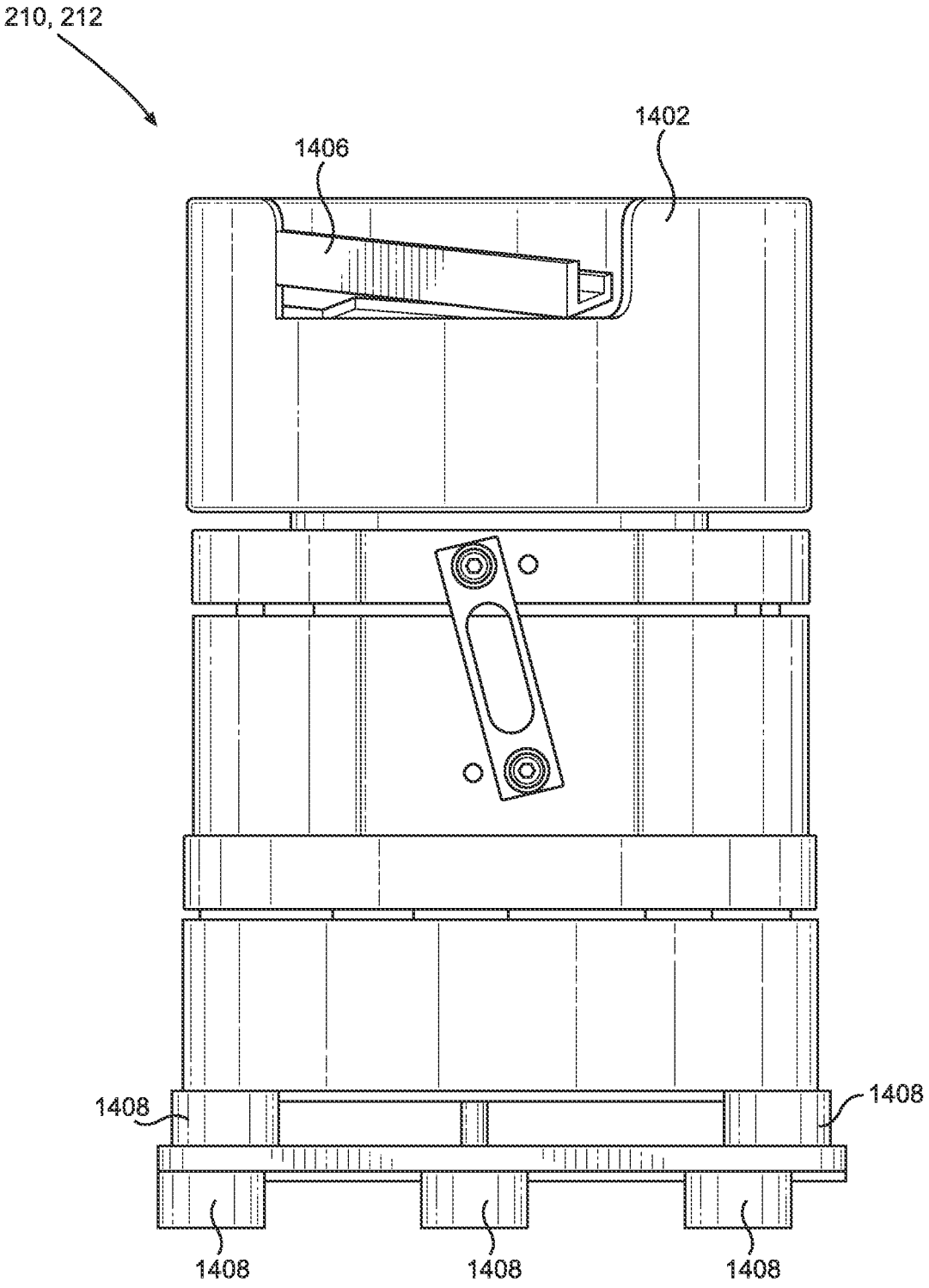
FIG. 16 is a schematic front view of the vibratory bowls in accordance with aspects of the current disclosure.
Figure 17:
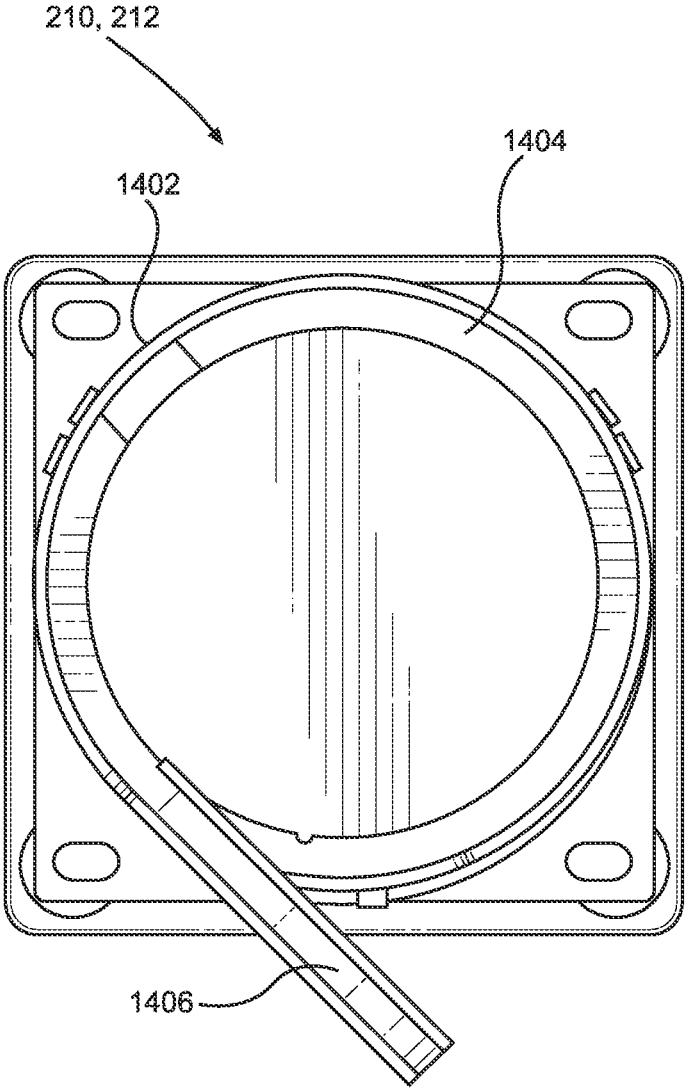
FIG. 17 is a schematic top view of the vibratory bowls in accordance with aspects of the current disclosure.

FIG. 14 is a perspective view of the vibratory bowls 210 and 212. FIG. 15 is a schematic side view of the vibratory bowls 210 and 212. FIG. 16 is a schematic front view of the vibratory bowls 210 and 212. FIG. 17 is a schematic top view of the vibratory bowls 210 and 212. The vibratory bowls 210 and 212 are the key to achieving an accurate weight. The process of weighing out a product is dependent on the flowability of the product. The vibratory bowls 210 and 212 enable a thin consistent flow of product that can be quickly shut off once the weigh modules 218 and 220 reach the target weight.

The vibratory bowls 210 and 212 are customized to meter the smokable product into the weigh bucket scoops 214 and 216 in a controlled and predictable way. As shown in FIGS. 14-17, the vibratory bowls 210 and 212 include a bowl 1402, a sweep 1404, and a channel 1406. The bowl 1402 is configured to contain and receive the smokable product from the linear feeder pans 206 and 208. The sweep 1404 is positioned within the bowl 1402 and is adjustable to control the flow of smokable product to the channel 1406. In the illustrated embodiment, the sweep 1404 includes a corkscrew ramp that is rotatably positioned within the bowl 1402 to move smokable product from the bowl 1402 to the channel 1406. The sweep 1404 is configured to rotate within the bowl 1402 such that smokable product is raised to the channel 1406. The speed and duration of rotation of the sweep 1404 may be adjusted to control the amount and consistency of smokable product fed to the channel 1406 and the weigh bucket scoops 214 and 216. The channel 1406 is attached to and extends from the bowl 1402 such that the channel 1406 extends over the weigh bucket scoops 214 and 216. As the smokable product is fed to the channel 1406 by the sweep 1404, the smokable product on the channel 1406 is push off the channel 1406 onto the weigh bucket scoops 214 and 216. The channel 1406 is sized and shaped to smoothly deliver smokable product to the weigh bucket scoops 214 and 216 in a controlled and consistent manner. The vibratory bowls 210 and 212 include supports 1408 that double isolate the vibratory bowls 210 and 212 from the remainder of the measuring station 200 to prevent vibration from affecting the rest of the system. As discussed herein, the main control console 236 includes a plurality of controls that variably and adjustably control the vibratory bowls 210 and 212.

Specifically, the main control console 236 includes controllers that include variable amplitude and frequency control that is adjustable. Because the consistency of the smokable product varies greatly, the controllers that control the vibratory bowls 210 and 212 may be varied to ensure the consistency of the smokable product fed to the measuring station 200 remains constant. The variable amplitude and frequency controllers that control the vibratory bowls 210 and 212 are used to meter the smokable product in a controlled and predictable manner. The vibratory bowls 210 and 212 can be both mechanically and electronically adjusted for product consistency. In the illustrated embodiment, the vibratory bowls 210 and 212 are powered by custom digitally adjustable 24 vdc variable amplitude and frequency controllers. As such, the vibratory bowls 210 and 212 rapidly flow the smokable product to the weigh bucket scoops 214 and 216 mounted on the weigh modules 218 and 220, to achieve fast cycle time, then slow down to meter the smokable product more precisely as the net weight nears the target. Accordingly, the vibratory bowls 210 and 212 are designed to precisely meter the smokable product to the weigh bucket scoops 214 and 216.

Figure 18:
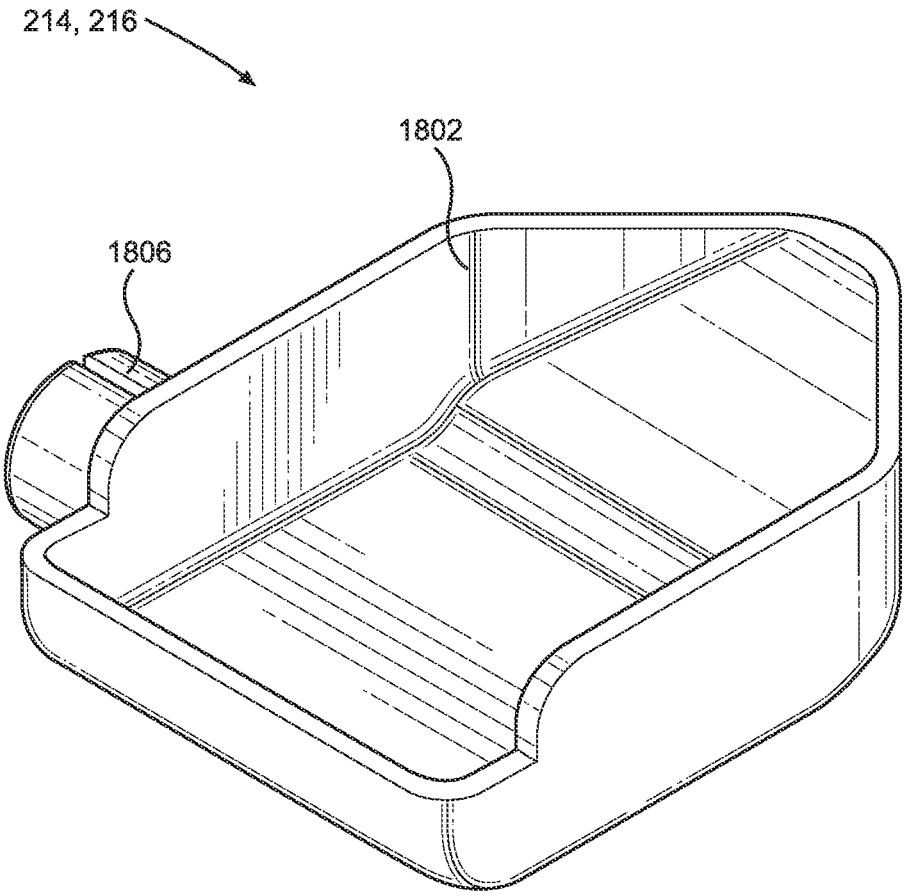
FIG. 18 is a perspective view of the weigh bucket scoops in accordance with aspects of the current disclosure.
Figure 19:
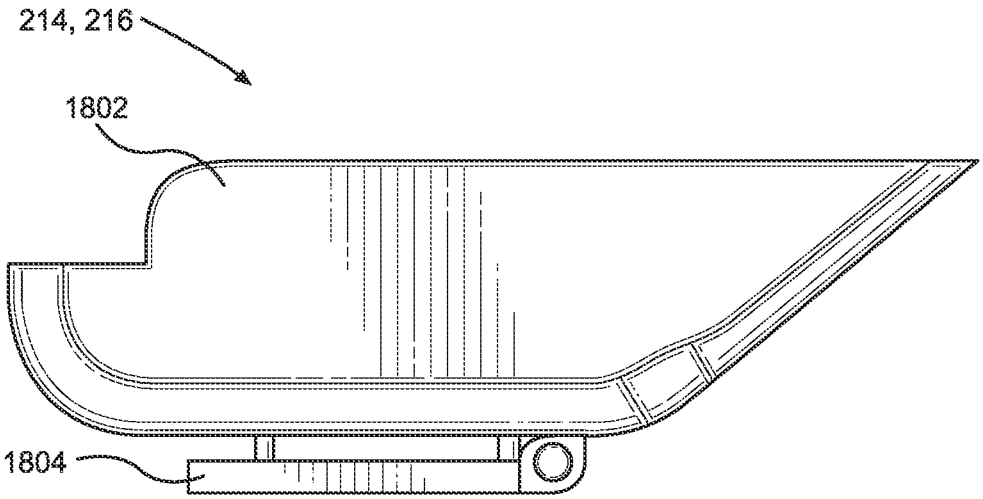
FIG. 19 is a schematic side view of the weigh bucket scoops in accordance with aspects of the current disclosure.
Figure 20:
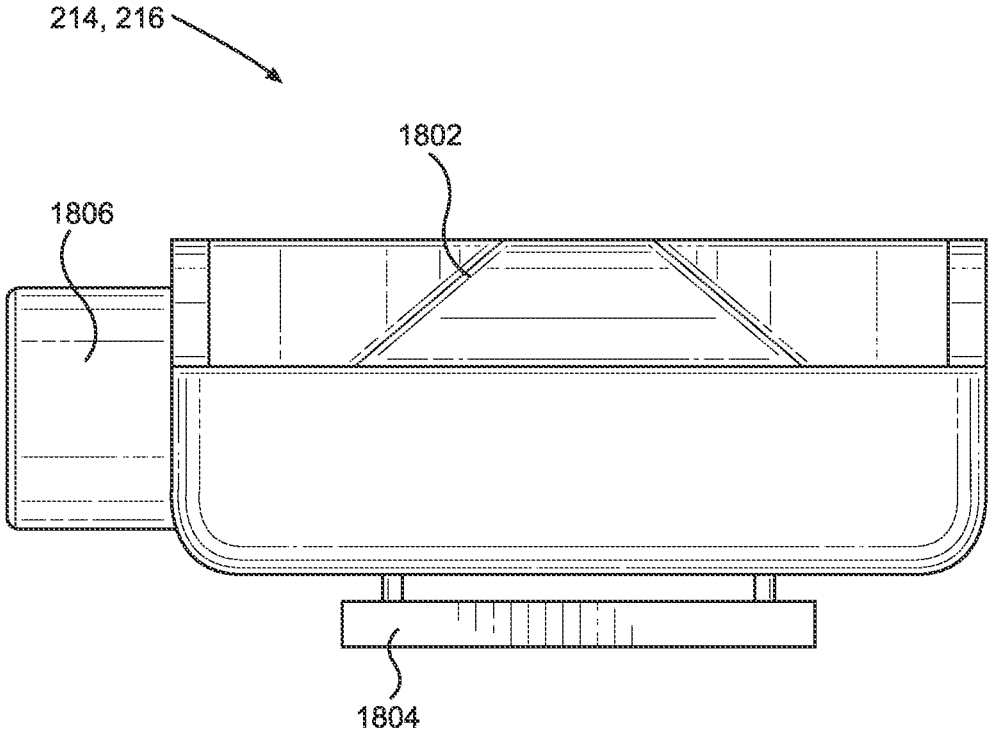
FIG. 20 is a schematic front view of the weigh bucket scoops in accordance with aspects of the current disclosure.
Figure 21:
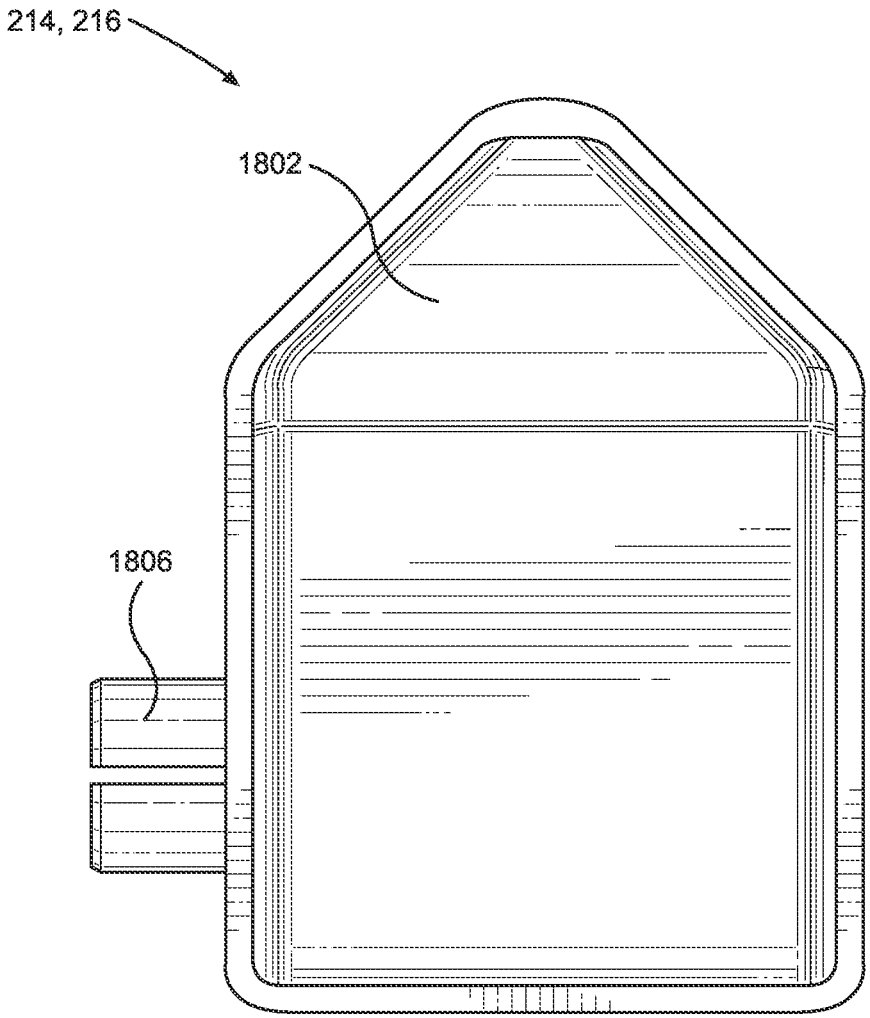
FIG. 21 is a schematic top view of the weigh bucket scoops in accordance with aspects of the current disclosure.
Figure 22:
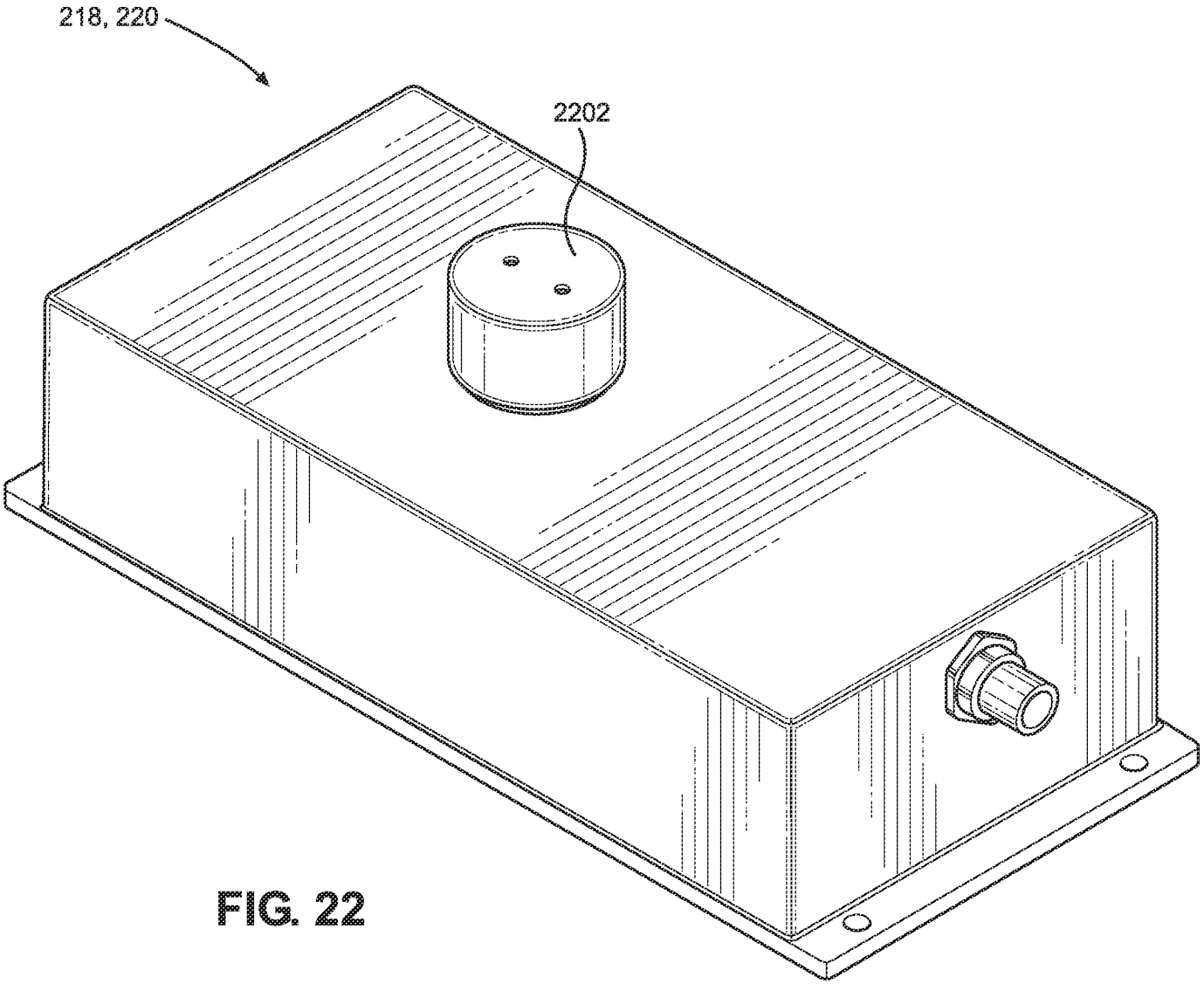
FIG. 22 is a perspective view of the weigh modules in accordance with aspects of the current disclosure.
Figure 23:
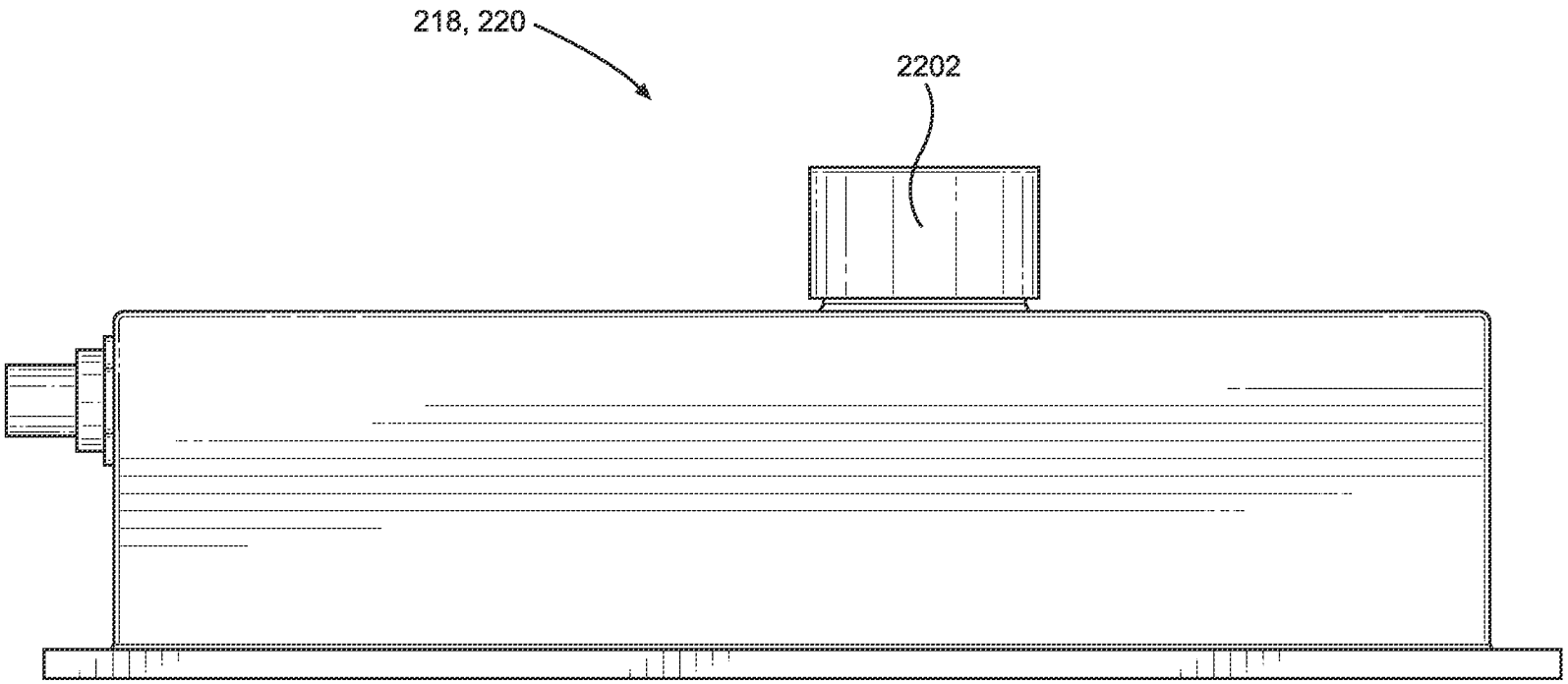
FIG. 23 is a schematic side view of the weigh modules in accordance with aspects of the current disclosure.
Figure 24:
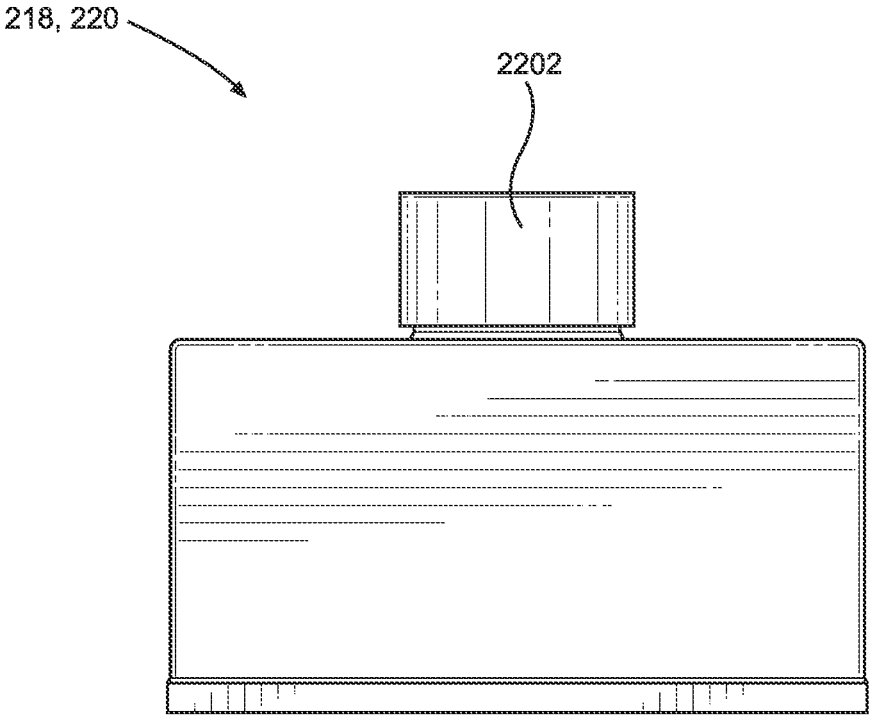
FIG. 24 is a schematic front view of the weigh modules in accordance with aspects of the current disclosure.
Figure 25:
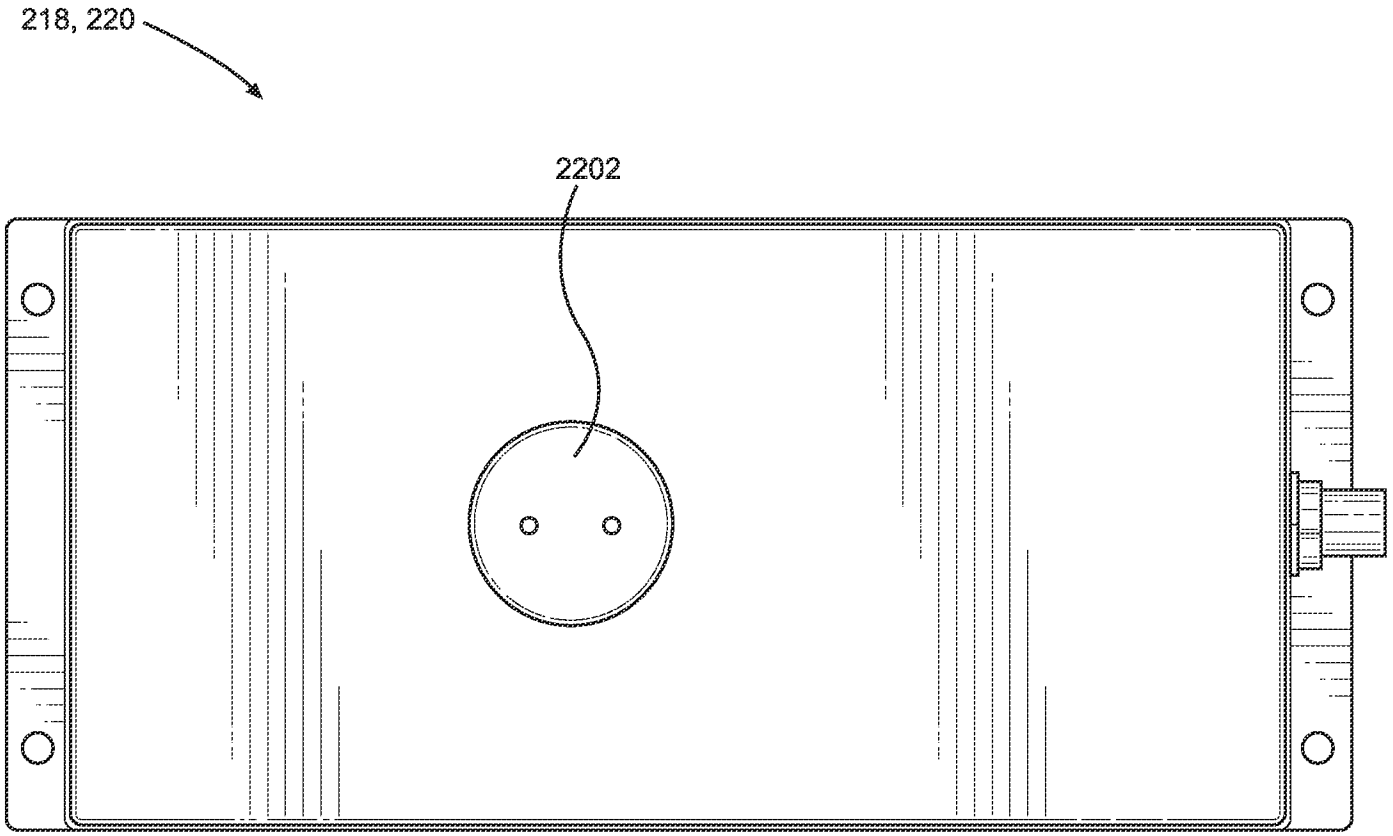
FIG. 25 is a schematic top view of the weigh modules in accordance with aspects of the current disclosure.

FIG. 18 is a perspective view of the weigh bucket scoops 214 and 216. FIG. 19 is a schematic side view of the weigh bucket scoops 214 and 216. FIG. 20 is a schematic front view of the weigh bucket scoops 214 and 216. FIG. 21 is a schematic top view of the weigh bucket scoops 214 and 216. FIG. 22 is a perspective view of the weigh modules 218 and 220. FIG. 23 is a schematic side view of the weigh modules 218 and 220. FIG. 24 is a schematic front view of the weigh modules 218 and 220. FIG. 25 is a schematic top view of the weigh modules 218 and 220. The weigh bucket scoops 214 are specially designed with shallow sides to minimize the product drop height from the vibratory bowls 210 and 212. This allows the weigh modules 218 and 220 to capture a more accurate weight. The closer the output of the vibratory bowls 210 and 212 is to the weigh bucket scoops 214, the more accurate the system will be.

The weigh bucket scoops 214 and 216 and the weigh modules 218 and 220 are used to precisely weigh the smokable product that is to be deposited into cavities 228. The weigh bucket scoops 214 and 216 are pivotably attached to the weigh modules 218 and 220 such that the smokable product is weighed and transferred to the cavities 228 by the weigh bucket scoops 214 and 216 and the weigh modules 218 and 220. Specifically, the weigh bucket scoops 214 and 216 are configured to receive the smokable product from the vibratory bowls 210 and 212 and pivot relative to the weigh modules 218 and 220 to deposit the smokable product in the cavities 228. The weigh modules 218 and 220 are configured to measure the weight of the smokable product to ensure that the amount of smokable product dispensed by the vibratory bowls 210 and 212 is within the predetermined tolerance of the predetermined amount of smokable product.

As shown in FIGS. 18-21, the weigh bucket scoops 214 and 216 include a scoop 1802, a hinge 1804, and a servo pivot attachment 1806. In the illustrated embodiment, the scoop 1802 is custom 3D printed out of amphora polymer for a light net weight design that complies with FDA regulations. In alternative embodiments, the scoop 1802 may be formed of any material and by any method that enables the weigh bucket scoops 214 and 216 to operate as described herein. The weigh bucket scoops 214 and 216 include a servo mechanism (not shown) to dump the smokable product into the feeders 222 and 224 after the predetermined amount of smokable product has been received. Additionally, the weigh bucket scoops 214 and 216 also include a small magnet that ensures stability when the scoop 1802 returns to its resting position and an air blow-off to clean the scoop 1802 after each cycle.

As shown in FIGS. 22-25, the weigh modules 218 and 220 include a scoop mount 2202 and isolation supports (not shown). In the illustrated embodiment, the weigh modules 218 and 220 include weight sensors that have a capacity from 1 gram to 100 kilograms. Preferably, the weigh modules 218 and 220 have a capacity of 1 kilogram. Additionally, the weigh modules 218 and 220 provide a resolution of 0.01 g, +/−0.02 g accuracy with the custom software. An analog output is read in increments of 1/10,000 of a millivolt (mv); or one millionth of a volt from the weigh modules 218 and 220. The weigh modules 218 and 220 are fitted with a custom cover to reduce interference and protect each weigh modules from damage. The scoop mount 2202 mount the weigh modules 218 and 220 to the hinge 1804 and the isolation supports isolate the weigh modules 218 and 220 from the rest of the measuring station 200.

One or more of the designed hoppers 202 and 204, the linear feeder pans 206 and 208, the vibratory bowls 210 and 212, the weigh bucket scoops 214 and 216, and the feeders 222 and 224 may include a coating that enables the system 100 to process a wider variety of smokable products. For example, at least some smokable products include infused smokable products and surfaces with a decreased coefficient of friction process infused smokable products more efficiently. As such, equipment within the system 100 that contacts the smokable product may be coated with a coating that decreases the coefficient of friction for the equipment and enable the equipment to process infused smokable product. In the illustrated embodiment, the portions of the designed hoppers 202 and 204, the linear feeder pans 206 and 208, the vibratory bowls 210 and 212, the weigh bucket scoops 214 and 216, and the feeders 222 and 224 that directly contact the smokable product are coated with a polytetrafluoroethylene (Teflon®) coating that is water resistant and lowers the coefficient of friction of the equipment.

As shown in FIG. 3, the feeders 222 and 224 each include a vertical channel 302 and a cone 304. The vertical channel 302 is attached to the system chassis 234 and the cone 304 is attached to the vertical channel 302. The vertical channel 302 receives the smokable product from the weigh bucket scoops 214 and 216 and feeds the smokable product to the cone 304. The cone 304 is cone shaped with a hole 306 at an end 308 of the cone 304 such that the smokable product is funneled into select cavities 228.

Figure 26:
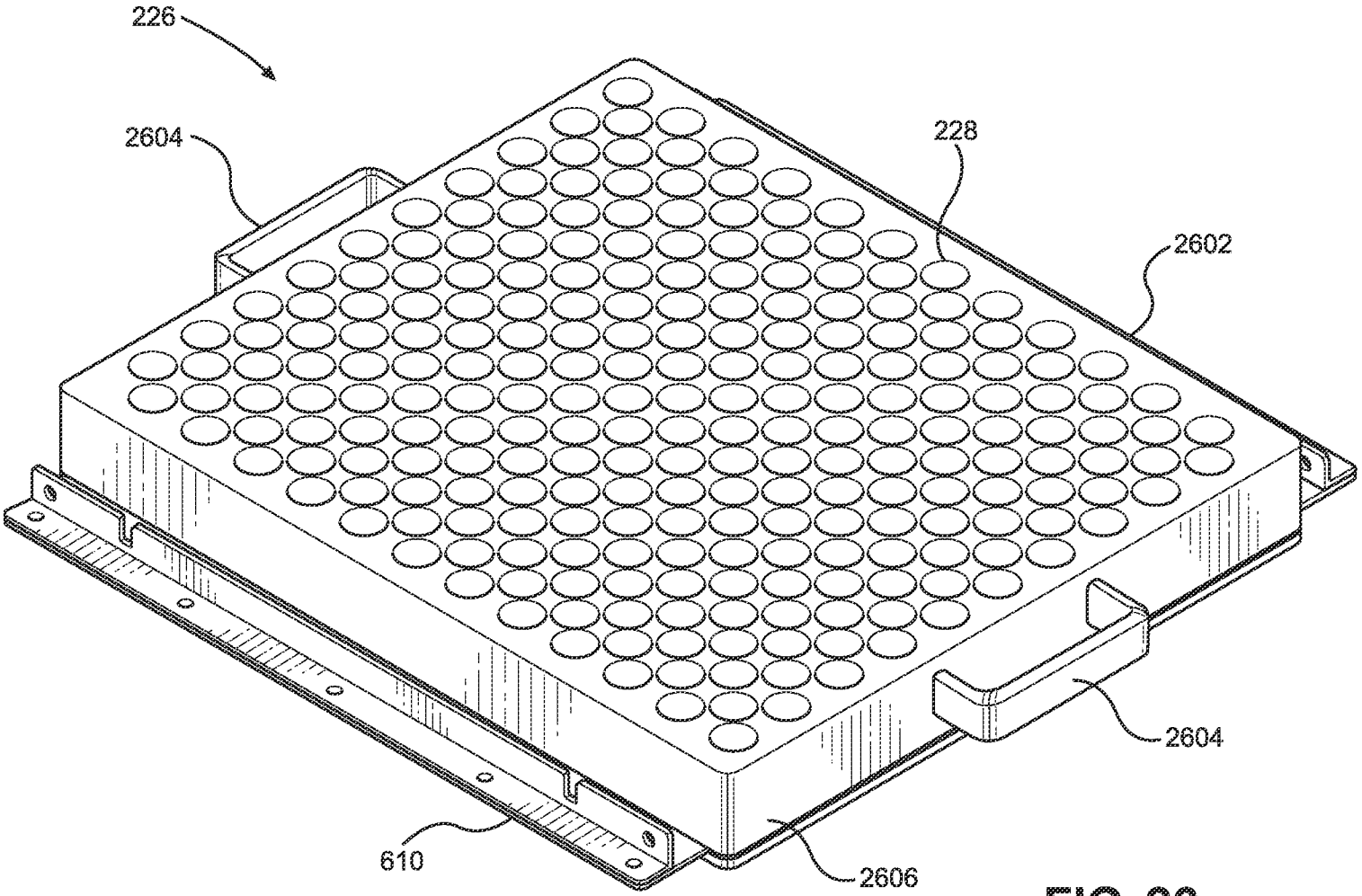
FIG. 26 is a perspective view of the puck in accordance with aspects of the current disclosure.
Figure 27:
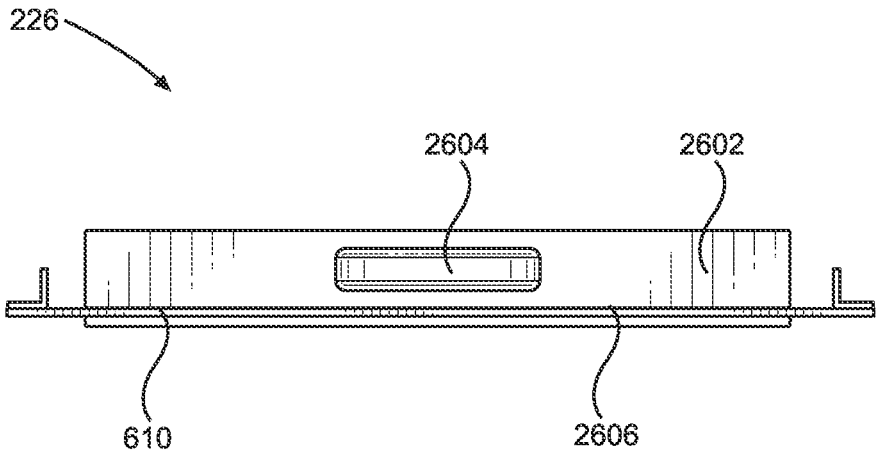
FIG. 27 is a schematic side view of the puck in accordance with aspects of the current disclosure.
Figure 28:
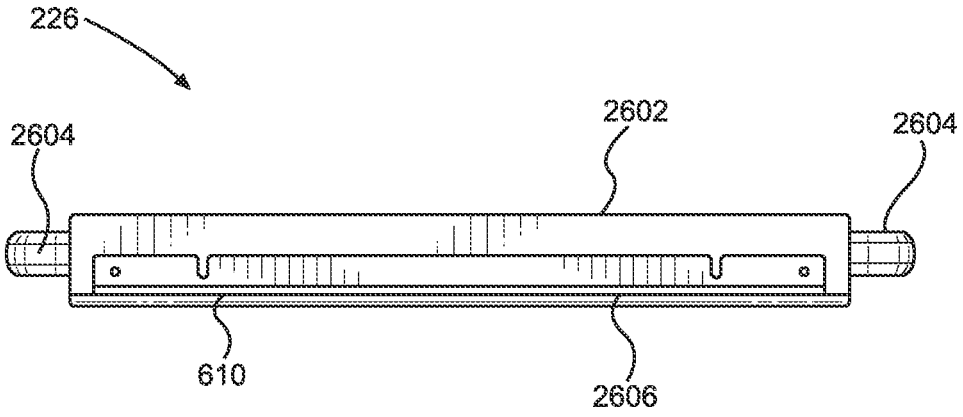
FIG. 28 is a schematic front view of the puck in accordance with aspects of the current disclosure.
Figure 29:
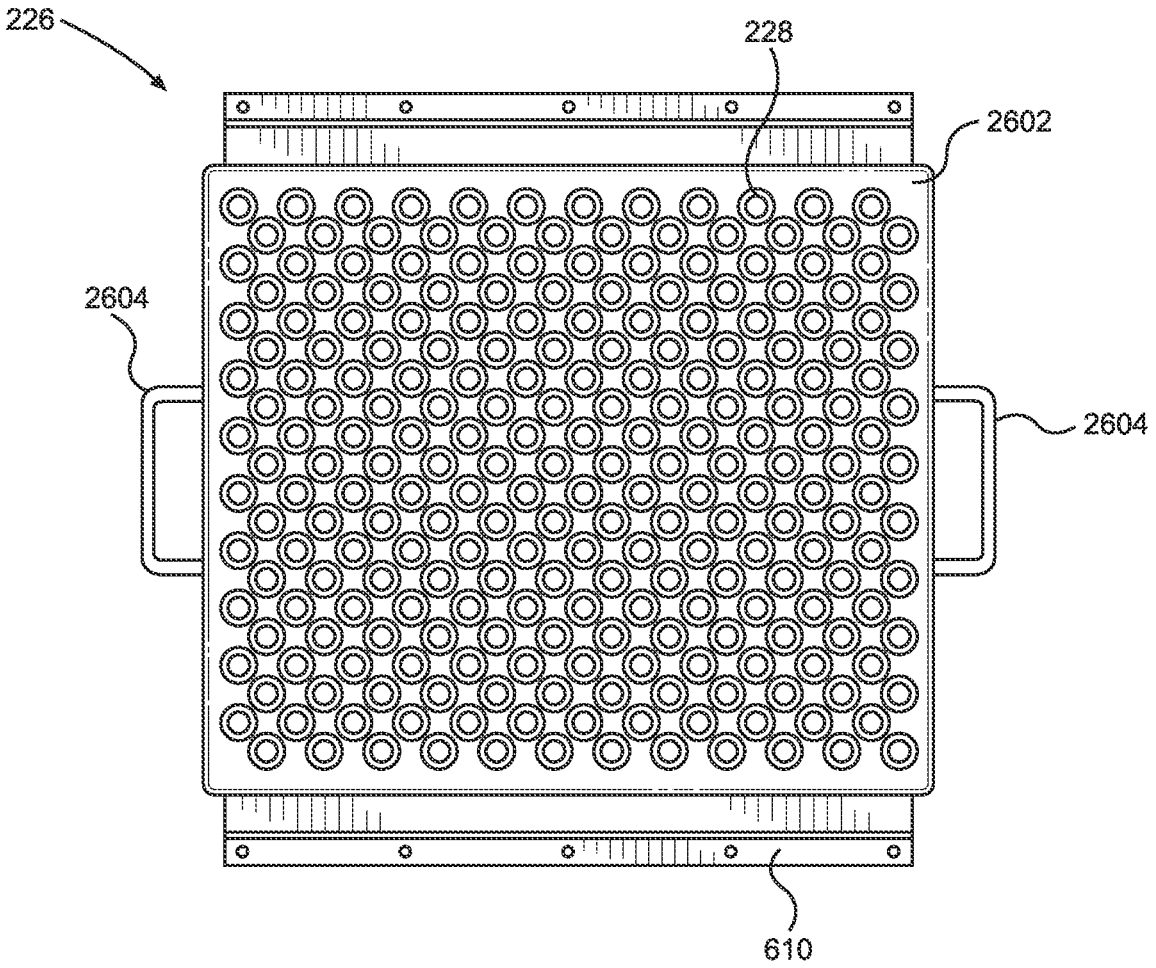
FIG. 29 is a schematic top view of the puck in accordance with aspects of the current disclosure.

FIG. 26 is a perspective view of the puck 226. FIG. 27 is a schematic side view of the puck 226. FIG. 28 is a schematic front view of the puck 226. FIG. 29 is a schematic top view of the puck 226. The puck 226 is specially designed to capture pre-weighed product in individual cavities that can be transported to a container without losing product. The low friction UHMW 610 has holes offset to the cavities that create an opening when the cavity and the hole are aligned.

As shown in FIGS. 26-29, the puck 226 includes a puck body 2602 and two handles 2604. The puck body 2602 defines the plurality of cavities 228, the handles 2604 are attached to the puck body 2602, and the first thin layer of low friction UHMW 610 is attached to a bottom 2606 of the puck body 2602. Preferably, the puck body 2602 defines 240 cavities 228 and is formed from any suitable material. In alternative embodiments, the puck body 2602 defines any number of cavities 228 that enables the puck 226 to operate as described herein. Preferably, the puck 226 is a custom designed and machined piece of acetal specially designed to catch all the dispensed product and transfer it to the feeders 222 and 224 with minimal product loss, less than 0.007 g. Additionally, the puck cavities are specifically designed and machined at a special angle $\alpha$, depending on the smokable product being deposited in the preroll cones, with a large enough diameter to prevent clogging.

The first thin layer of low friction UHMW 610 maintains the smokable product in the cavities 228 when the puck 226 is moved to the tamping station 600 for further processing. More specifically, the first thin layer of low friction UHMW 610 is used as a slide plate and latched in place with a latch (not shown). Once the puck 226 is filled and positioned above the preroll cones, the latch is released and the first thin layer of low friction UHMW 610 slides to allow the smokable product to fall into the preroll cones.

Figure 30:
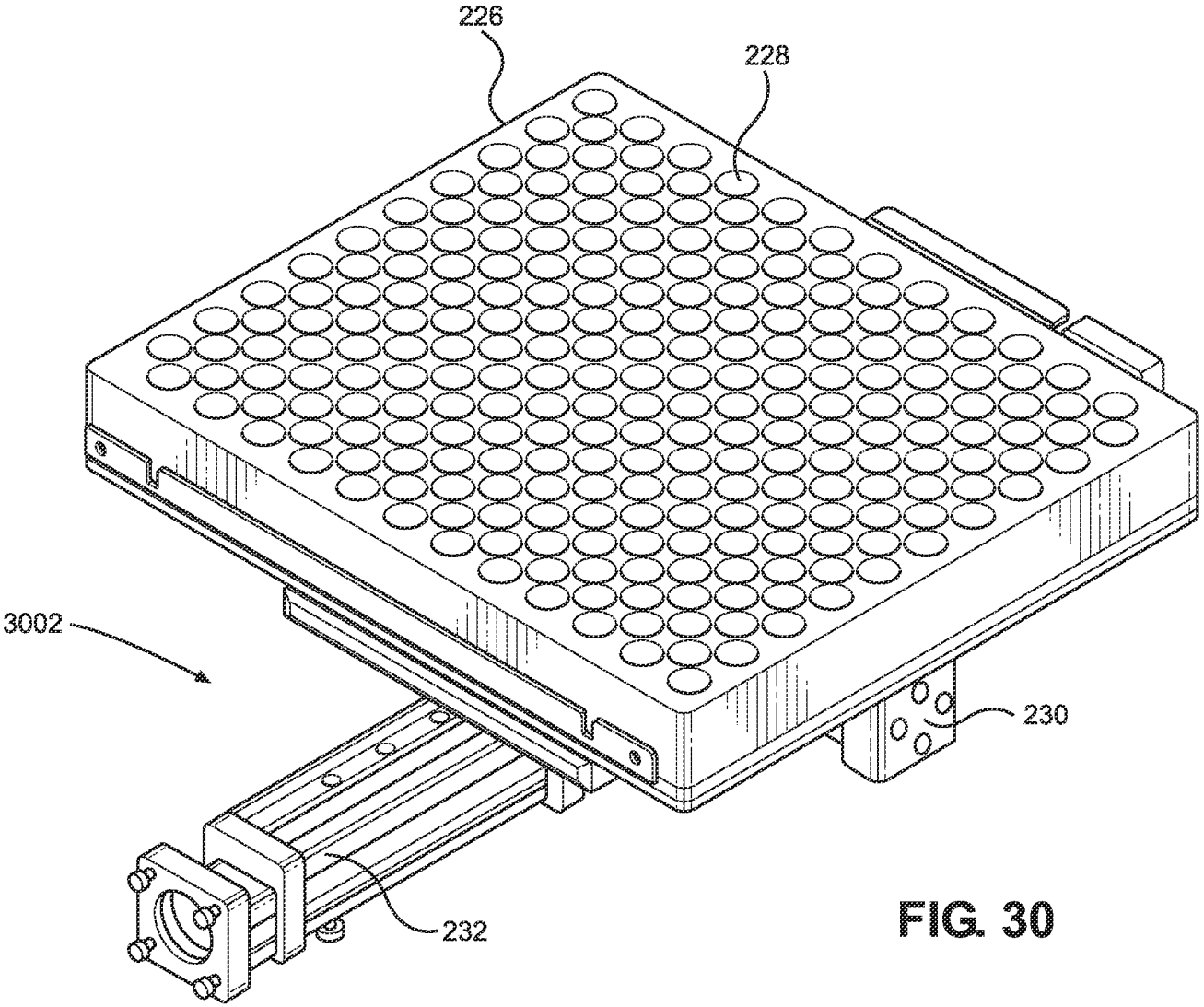
FIG. 30 is a perspective view of the puck, the X-axis orienter, and the Y-axis orienter in accordance with aspects of the current disclosure.
Figure 31:
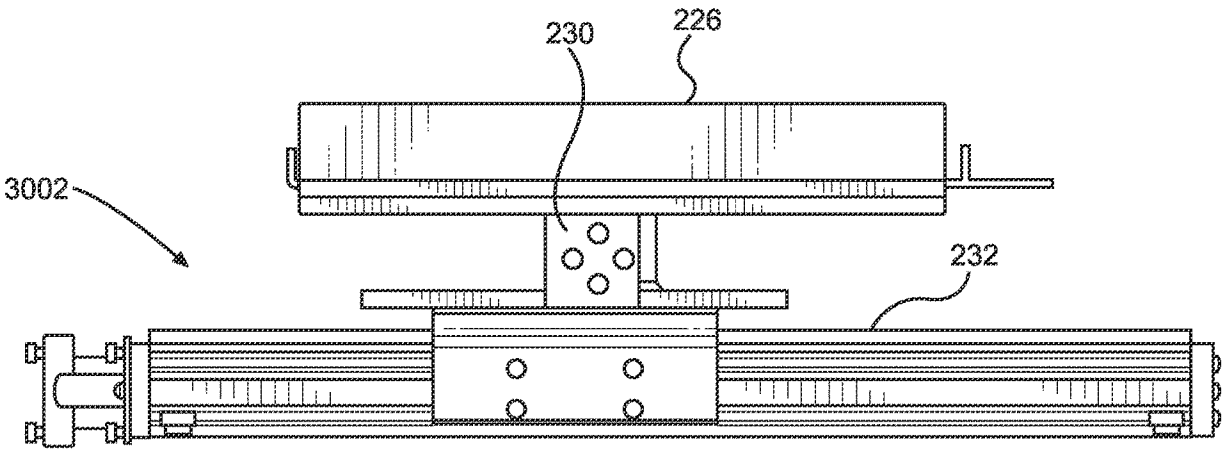
FIG. 31 is a schematic side view of the puck, the X-axis orienter, and the Y-axis orienter in accordance with aspects of the current disclosure.
Figure 32:
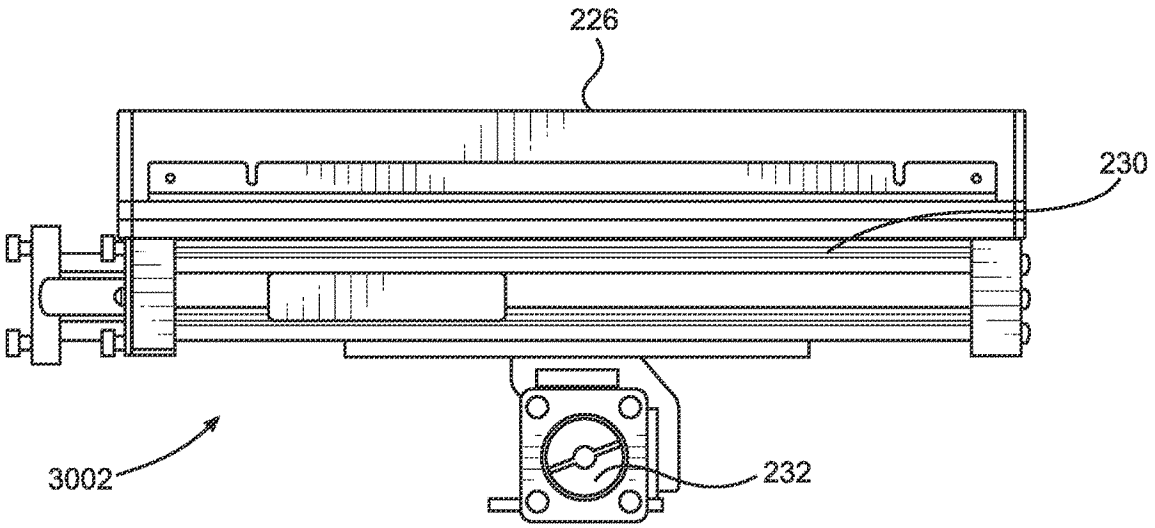
FIG. 32 is a schematic front view of the puck, the X-axis orienter, and the Y-axis orienter in accordance with aspects of the current disclosure.
Figure 33:
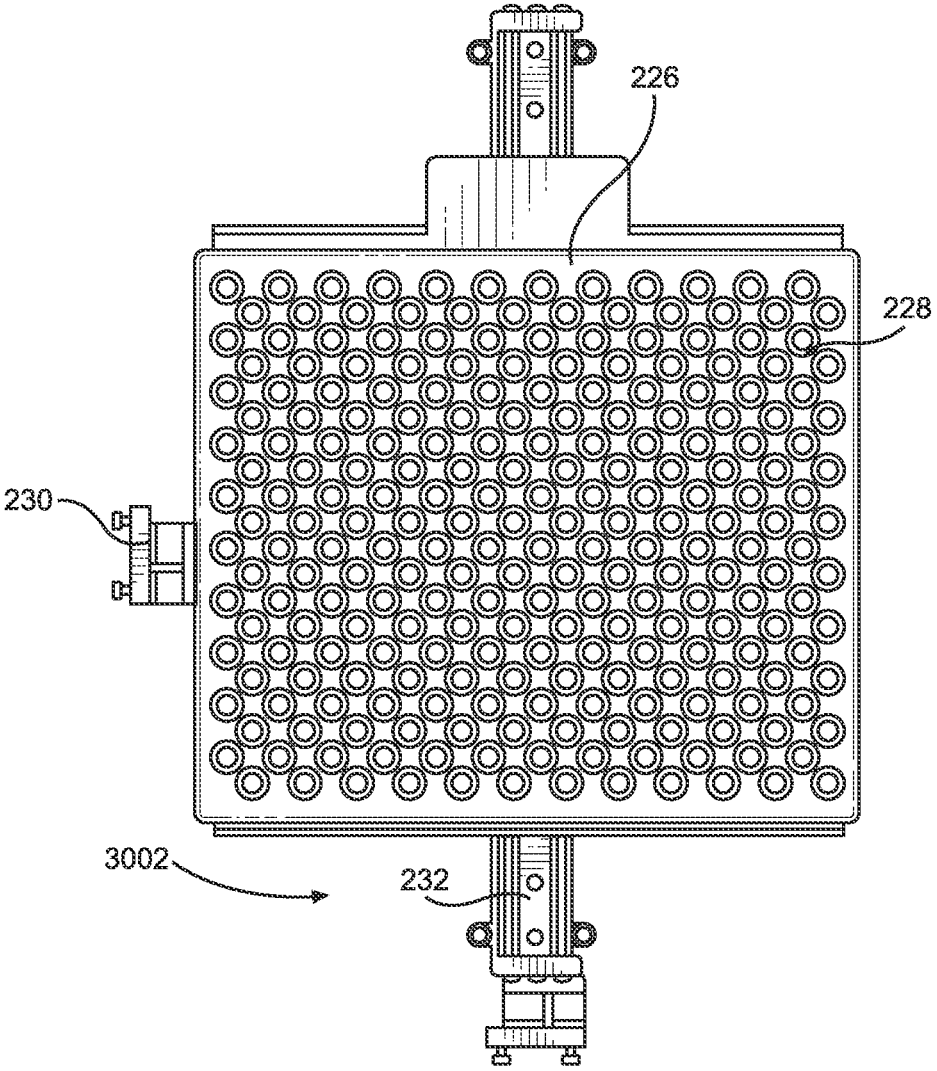
FIG. 33 is a schematic top view of the puck, the X-axis orienter, and the Y-axis orienter in accordance with aspects of the current disclosure.

FIG. 30 is a perspective view of the puck 226, the X-axis orienter 230, and the Y-axis orienter 232. FIG. 31 is a schematic side view of the puck 226, the X-axis orienter 230, and the Y-axis orienter 232. FIG. 32 is a schematic front view of the puck 226, the X-axis orienter 230, and the Y-axis orienter 232. FIG. 33 is a schematic top view of the puck 226, the X-axis orienter 230, and the Y-axis orienter 232

As shown in FIGS. 30-33, the puck 226 is attached to the X-axis orienter 230, the X-axis orienter 230 is attached to the Y-axis orienter 232, and the Y-axis orienter 232 is attached to the system chassis 234. The X-axis orienter 230 and the Y-axis orienter 232 together define an XY orienter 3002. The X-axis orienter 230 and the Y-axis orienter 232 each include at least two linear actuators driven by high precision smart motors. Additionally, the X-axis orienter 230 and the Y-axis orienter 232 are specifically programmed with custom software comprising instructions executable on at least one processor to move with $1/10{,}000$ of an inch precision. The X-axis orienter 230 includes at least one 250 mm stroke motor and the Y-axis orienter 232 includes at least one 450 mm stroke motor. Both actuators of the X-axis orienter 230 and the Y-axis orienter 232 work with each other to move to the puck 226 so that all 240 cavities on the puck 226 can be filled by the measuring station 200.

Figure 34:
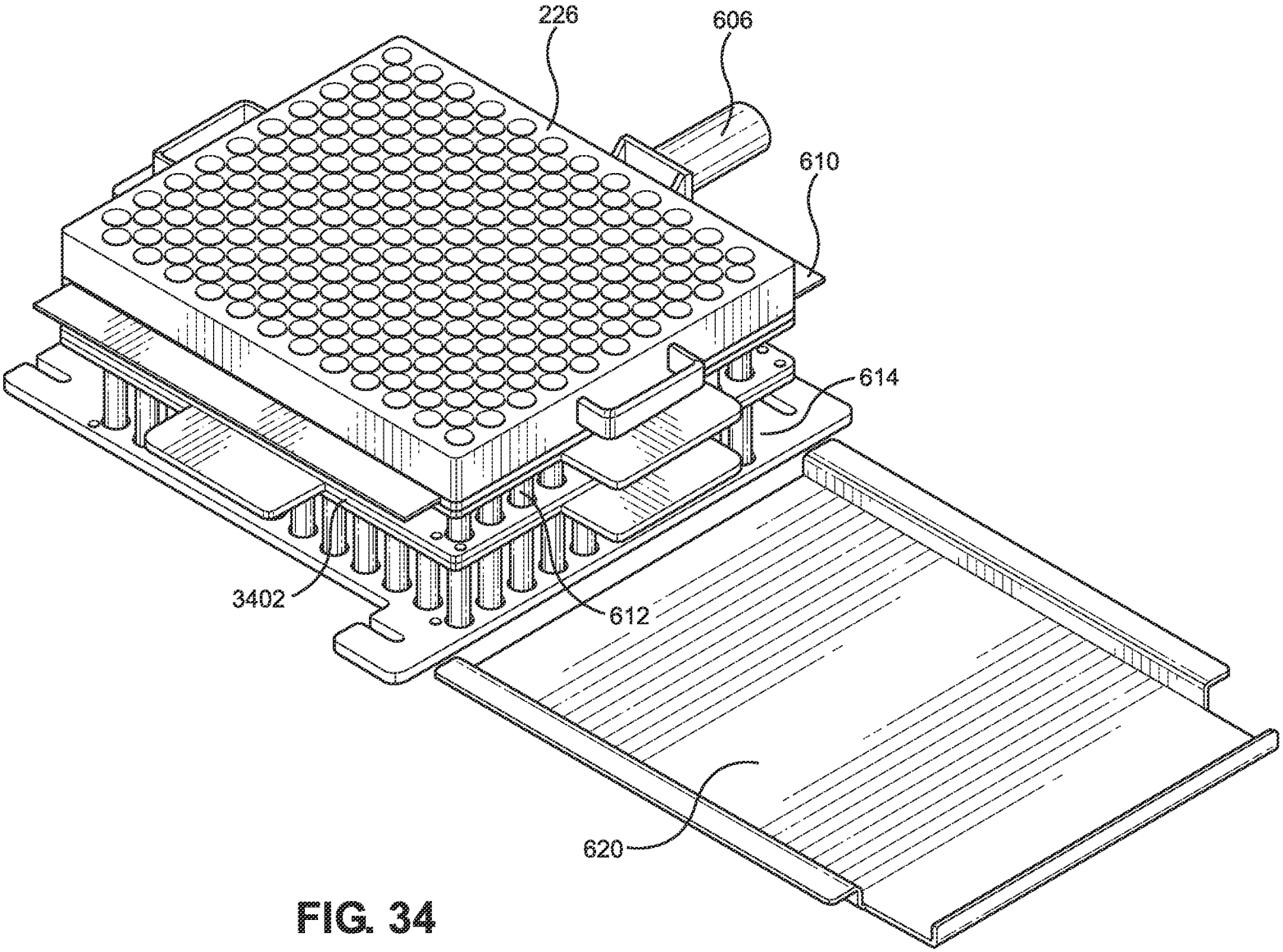
FIG. 34 is a perspective view of the upper tube assembly, the lower tube assembly, and the puck in accordance with aspects of the current disclosure.
Figure 35:
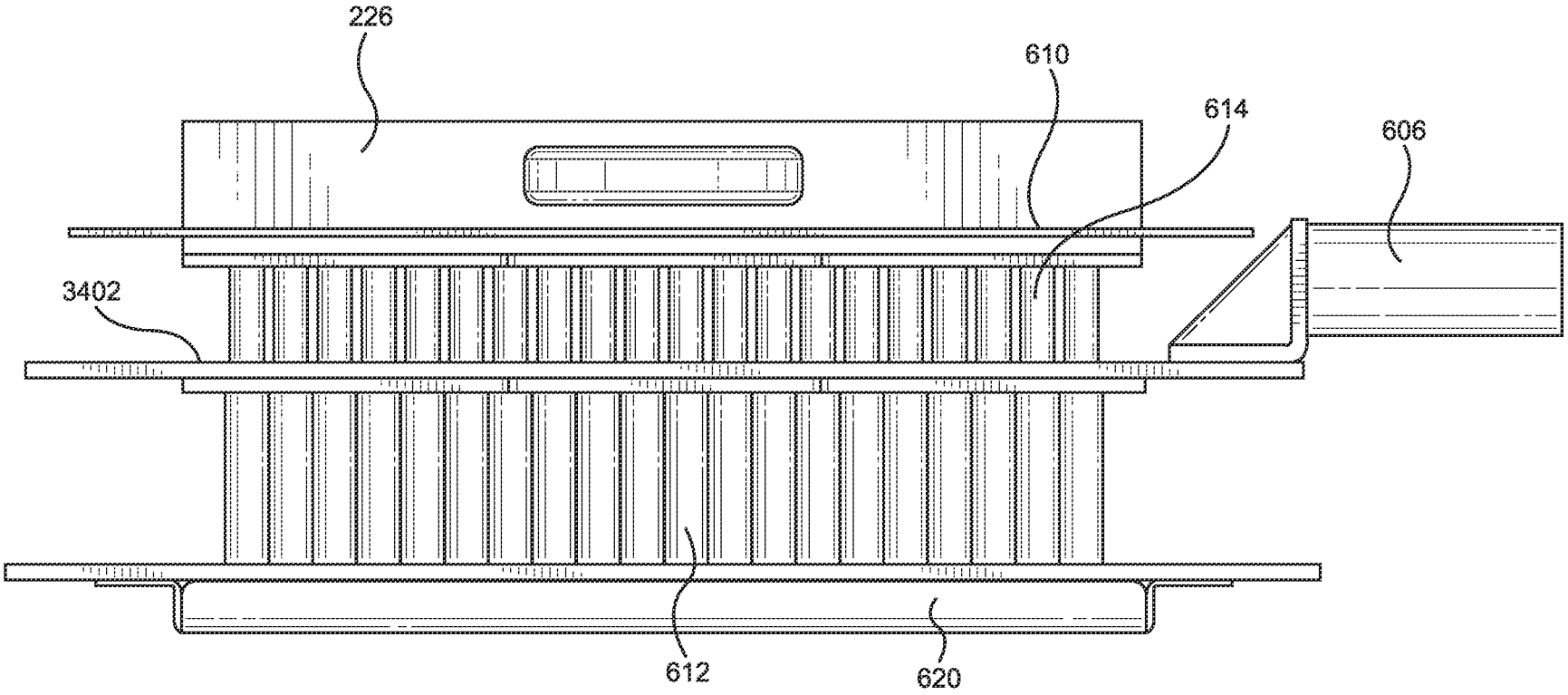
FIG. 35 is a schematic side view of the upper tube assembly, the lower tube assembly, and the puck in accordance with aspects of the current disclosure.
Figure 36:
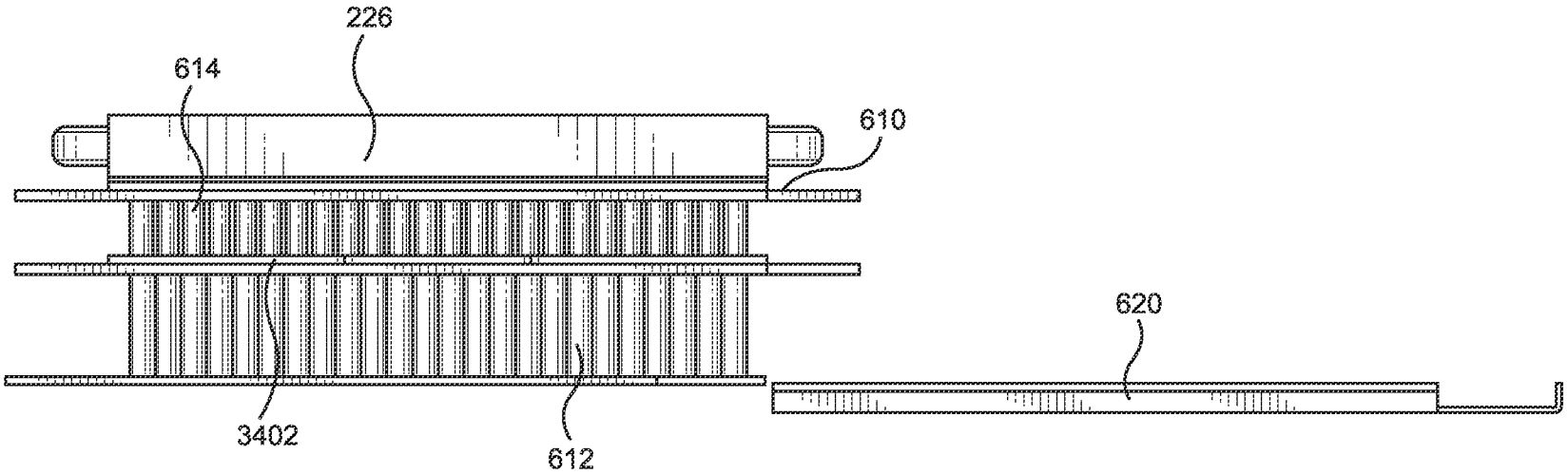
FIG. 36 is a schematic front view of the upper tube assembly, the lower tube assembly, and the puck in accordance with aspects of the current disclosure.

FIG. 34 is a perspective view of the upper tube assembly 612, the lower tube assembly 614, and the puck 226. FIG. 35 is a schematic side view of the upper tube assembly 612, the lower tube assembly 614, and the puck 226. FIG. 36 is a schematic front view of the upper tube assembly 612, the lower tube assembly 614, and the puck 226.

As shown in FIGS. 34-36, when the puck 226 is moved to the tamping station 600, a second thin layer of low friction UHMW 3402 is stacked on the lower tube assembly 614, the upper tube assembly 612 is stacked on the second thin layer of low friction UHMW 3402, the first thin layer of low friction UHMW 610 is stacked on the upper tube assembly 612, and the puck 226 is stacked on the first thin layer of low friction UHMW 610. The pneumatic piston 606 is attached to the second thin layer of low friction UHMW 3402 to enable the pneumatic piston 606 vibrate the upper tube assembly 612, the lower tube assembly 614, and the puck 226 to settle smokable product in the cones.

During operations, the cones are preassembled and placed in the upper tube assembly 612 and seated into the upper tube assembly 612 using the air nozzle 604. The puck 226 is filled with smokable product as described above. The first thin layer of low friction UHMW 610 is attached to the puck 226 such that the smokable product remains in the cavities 228. The puck 226 and the first thin layer of low friction UHMW 610 are stacked onto the upper tube assembly 612 and the lower tube assembly 614. The seating platform is in the state position and the first thin layer of low friction UHMW 610 is removed to enable the smokable product to fall into the cones. The upper tube assembly 612, the lower tube assembly 614, and the puck 226 are vibrated by the pneumatic piston 606 to settle the smokable product in the cones. The puck 226 is removed and returned to the measuring station 200. The seating platform 608 is lowered to tamping position by the long air cylinder 618. The cones descend from the upper tube assembly 612 to the loose, frictionless lower tube assembly 614 and are continuously vibrated. The short air cylinder 616 has software and hardware that control amplitude and stroke for a tamping action and bounces the cones to compaction. The upper tube assembly 612 is removed to expose the filled, tamped cones. The precisely filled, tamped cones are then slid onto the receiving tray 620 with no loss of product and are slightly elevated to expose the cones for ease of access for removal and/or end twisting.

The procedure described above produces the final product in two stages. The first stage is a tight stage, and the second stage is a loose stage. Before the puck 226 is placed on the upper tube assembly 612, the cones are placed in the custom-made upper tube assembly 612 then seated with the air nozzle 604. The puck 226 is placed on top of the upper tube assembly 612 and then product is vibrated into the cones. Because the cones fit tightly (hence the need to seat them with air) there is no leakage. The next step is to lower the filled prerolled cones to the second level of loose tubes of the lower tube assembly 614 by removing the puck 226 while simultaneously using both air and vibration to get the filled prerolled cones and the seating platform 608 support into the lower tube assembly 614. Now that the filled preroll cones are in the bottom, loose, tubes of the lower tube assembly 614, the custom designed seating platform 608 vibrates up and down causing the cones to be tamped. The duration of this process determines the degree of firmness which is set by the operator. The precisely filled, tamped cones are then slid onto the receiving tray 620 with no loss of product so that the final cone net weight remains the regulatory required +/−3%. The tops of the cones are slightly elevated to expose them for ease of access for removal and/or end twisting.

The upper tube assembly 612 guides all the smokable product into the preroll cones. Additionally, the pneumatic piston 606 is attached to the upper tube assembly 612 to move all the smokable product from the puck 226 to the lower tube assembly 614. The lower tube assembly 614, also referred to as loose fit tubes, are also custom sized for frictionless tamping.

Figure 37:
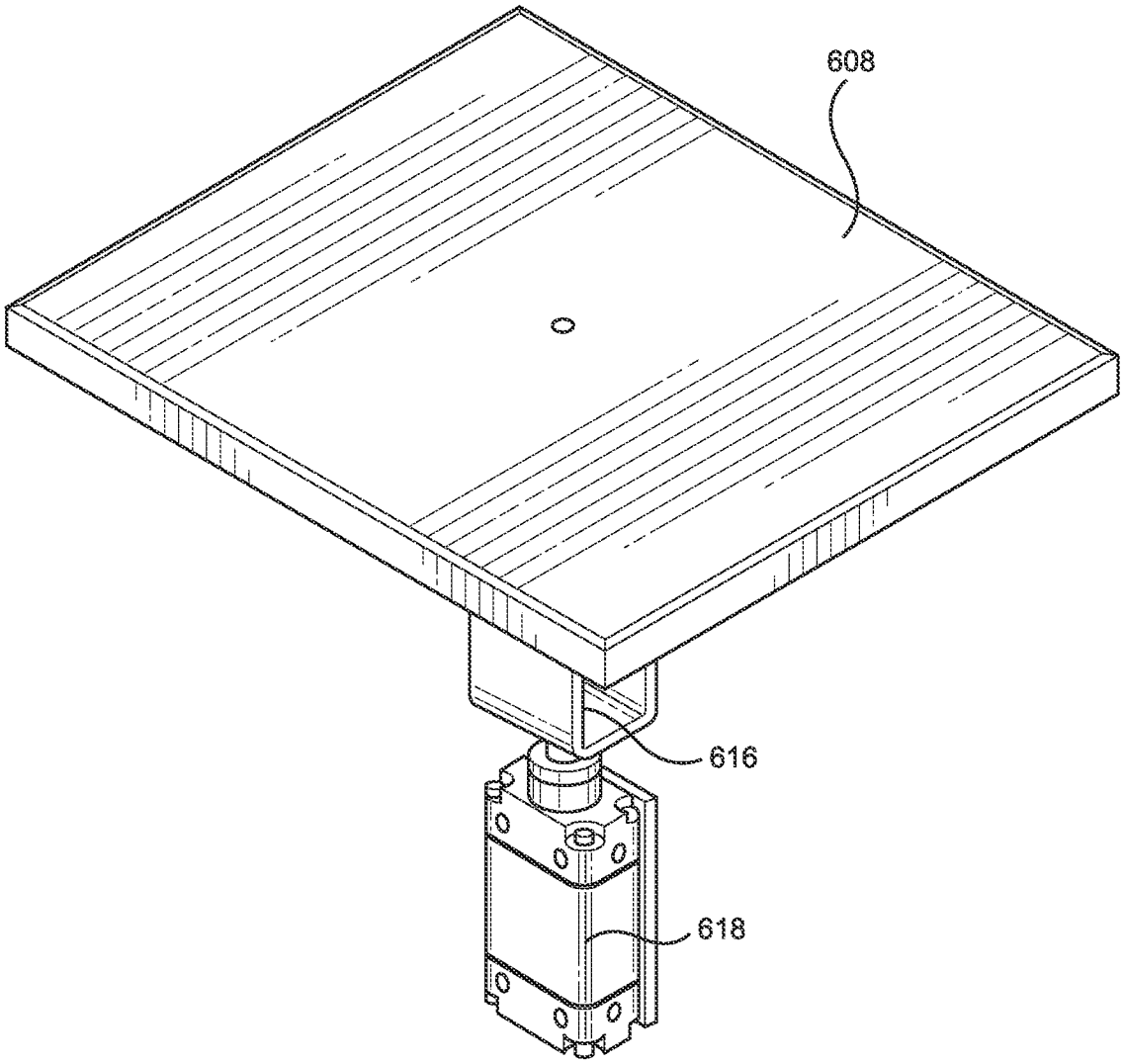
FIG. 37 is a perspective view of the seating platform, the short air cylinder, and the long air cylinder in accordance with aspects of the current disclosure.
Figure 38:
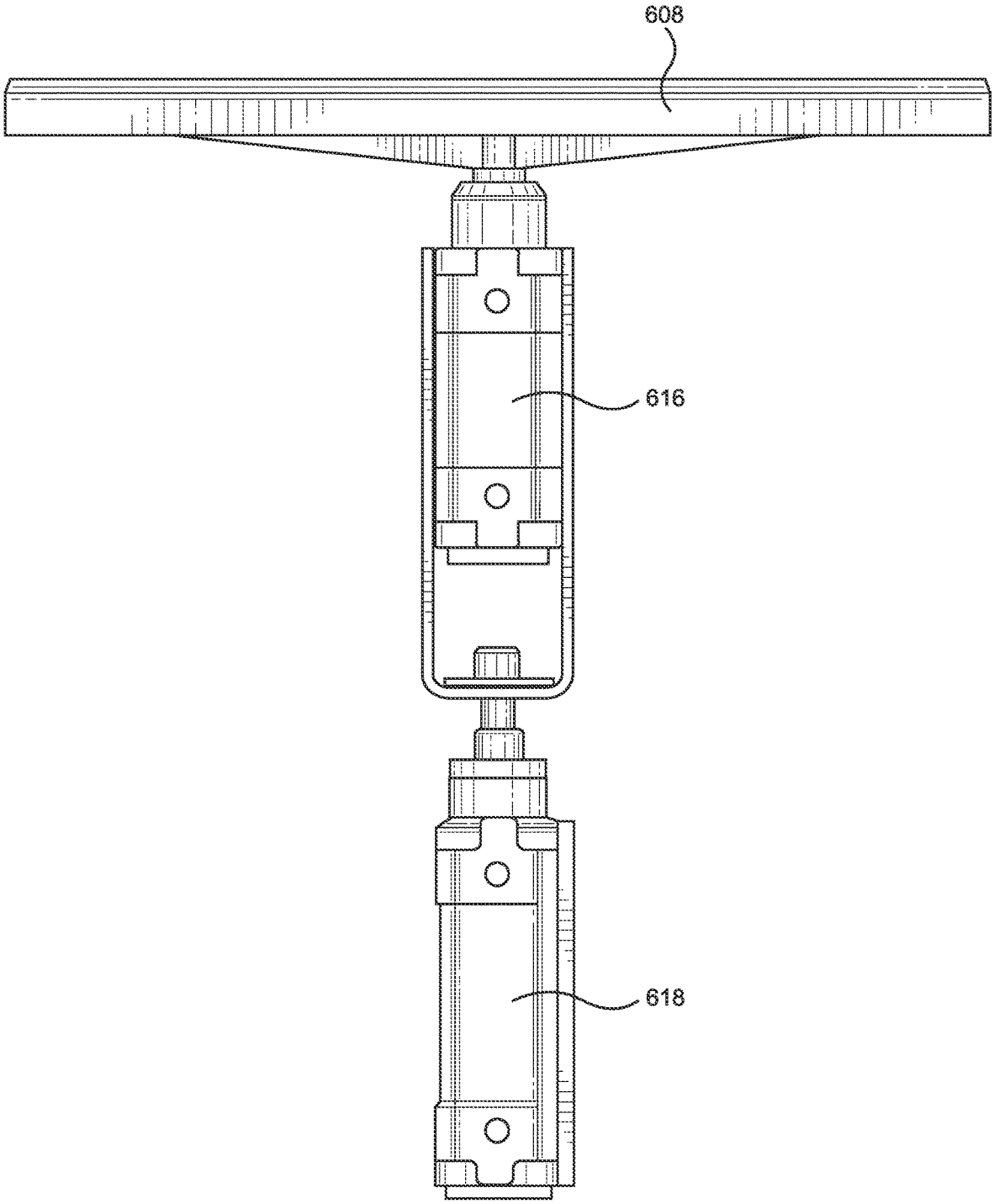
FIG. 38 is a schematic side view of the seating platform, the short air cylinder, and the long air cylinder in accordance with aspects of the current disclosure.
Figure 39:
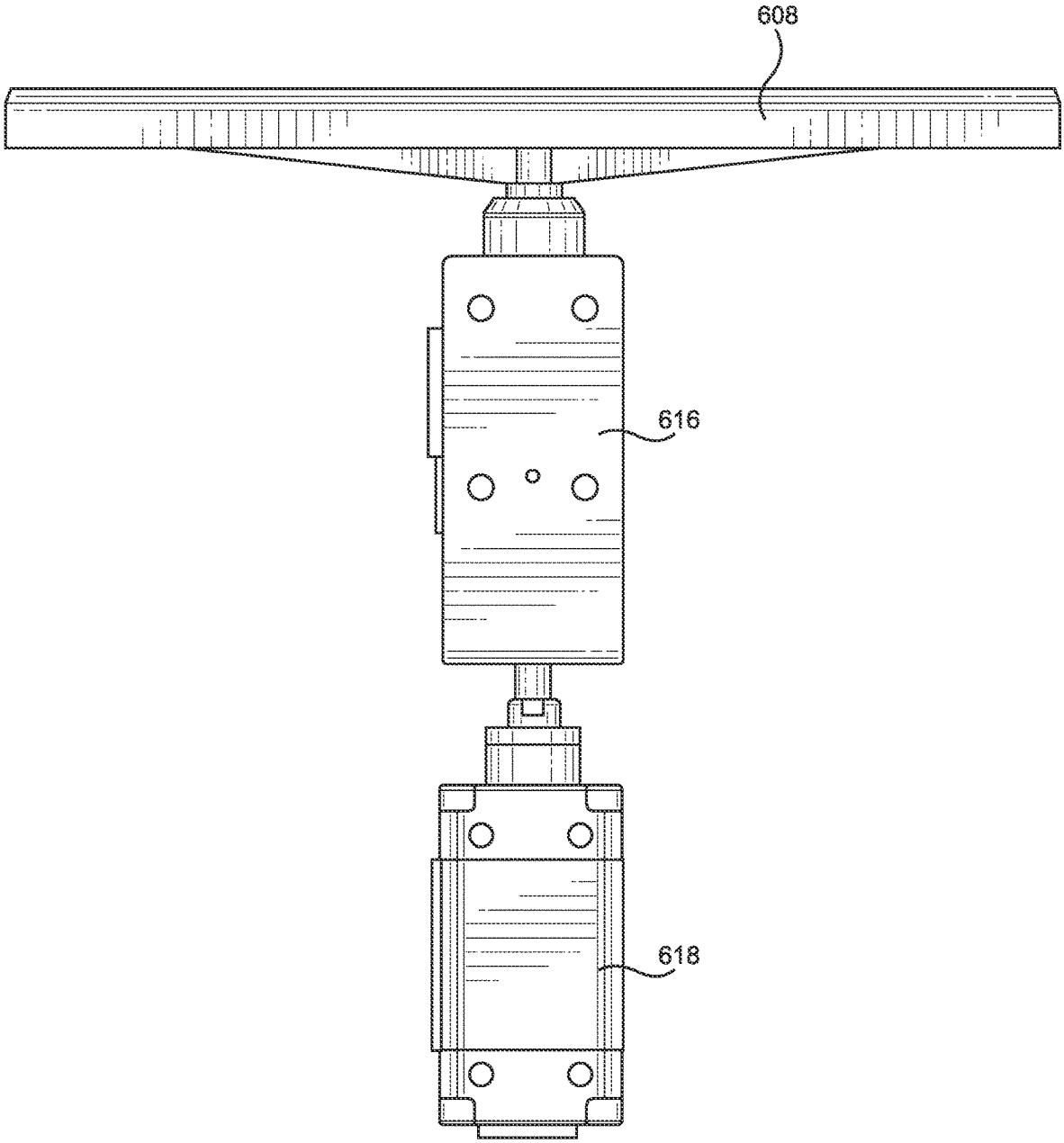
FIG. 39 is a schematic front view of the seating platform, the short cylinder, and the long air cylinder in accordance with aspects of the current disclosure.
Figure 40:
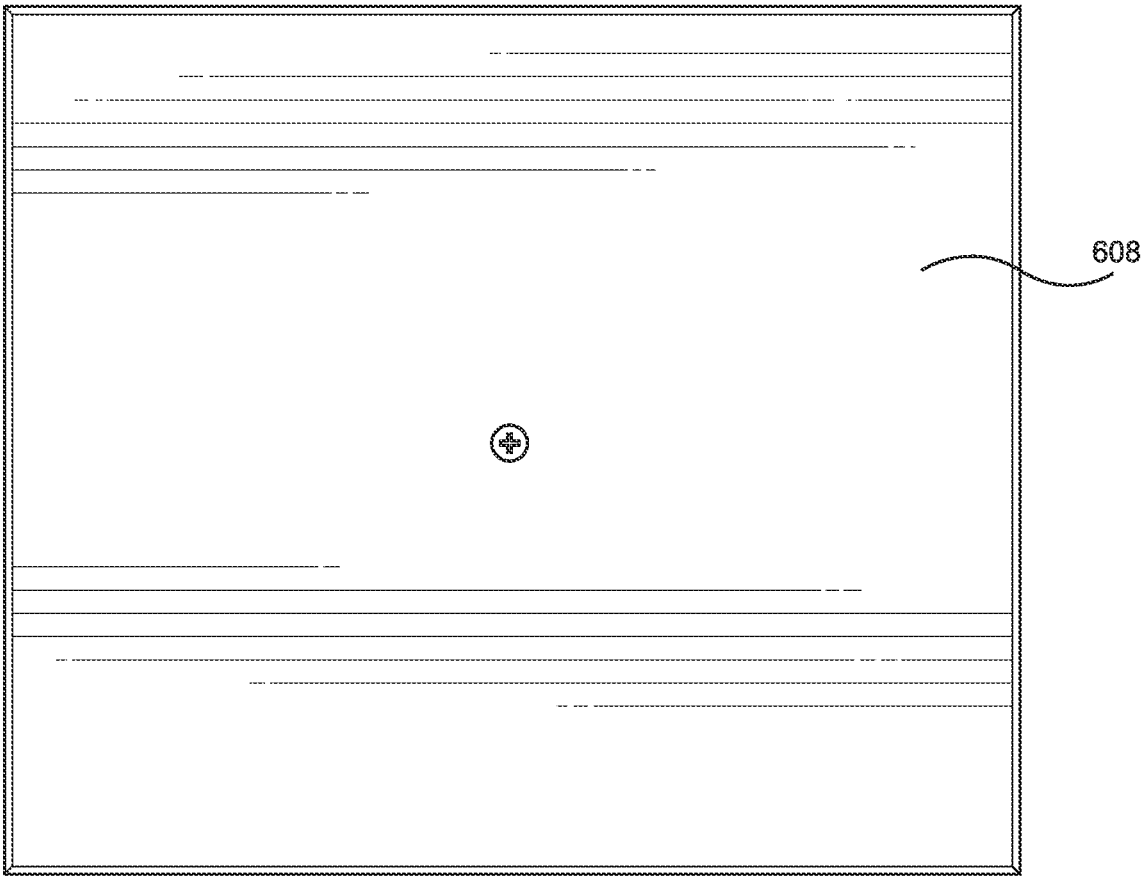
FIG. 40 is a schematic top view of the seating platform, the short air cylinder, and the long air cylinder in accordance with aspects of the current disclosure.

FIG. 37 is a perspective view of the seating platform 608, the short air cylinder 616, and the long air cylinder 618. FIG. 38 is a schematic side view of the seating platform 608, the short air cylinder 616, and the long air cylinder 618. FIG. 39 is a schematic front view of the seating platform 608, the short air cylinder 616, and the long air cylinder 618. FIG. 40 is a schematic top view of the seating platform 608, the short air cylinder 616, and the long air cylinder 618.

The long air cylinder 618 moves the seating platform 608 from the filling position (tight tubes) to the tamping position (loose tubes) and back up to be transferred onto the lower tube assembly 614. The short air cylinder 616 is equipped with specialty software and hardware to control the short air cylinder 616 amplitude and stroke for a desired tamping action and "bounces" the cones to compaction according to customer preferences. The seating platform 608 supports and tamps the cones to form an even pack while seated in the "loose" tubes. the platform has two positions, "up", or "start", and "down", or "tamp".

Figure 41:
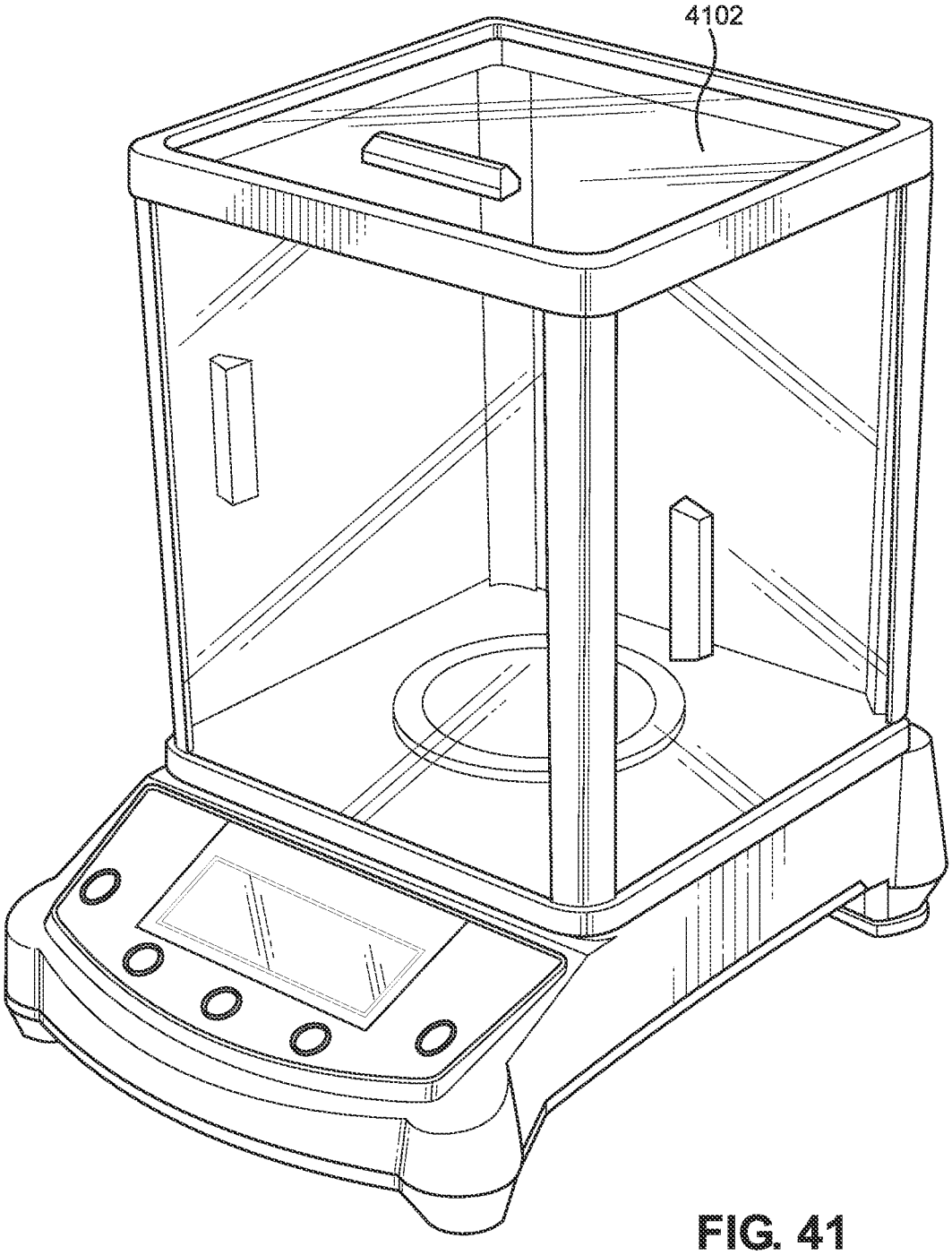
FIG. 41 illustrates a perspective view of a digital scale for measuring the accuracy of the smokable product contained in the prerolls in accordance with aspects of the current disclosure.

FIG. 41 illustrates a perspective view of a digital scale 4102 for measuring the accuracy of the smokable product contained in the prerolls. Quality control, if desired, may then be done by randomly selecting cones of the finished rack of 240 prerolls and emptying the contents into a container on the NTE approved milligram tabletop balance or digital scale 4102.

The system 100 further comprises software, firmware, and custom circuit boards to provide precision net weigh automation to achieve resolution and accuracy of 0.01 g using weigh module technology. The system 100 therefore achieves a resolution and accuracy others can only achieve with force restoration technology.

As can be seen, the measuring station 200 is completely enclosed in the system chassis 234 to isolate contact surfaces from major electronics, pneumatics, wires, etc. housed in the system chassis 234. Access hatches allow for easy access during service. Additionally, all electronics, logical components, control boards, interface elements are located an in exterior mounted enclosure. Polyethylene Terephthalate (P.E.T.) buckets minimize static electricity providing product accrual prevention and limiting product loss of USDA/FDA compliant material.

The main control console 236 is also attached to the system chassis 234. The main control console 236 is located in the front of the measuring station 200 and electronically connected to a main control box in a box in the rear of the measuring station 200 that is sized to contain all the electronics required to operate the measuring station 200. Controls contained in the main control box can be adjusted manually through a custom graphical user interface on the main control console 236 using an input device selected from the group consisting of a touchscreen, a stylus, a keyboard and mouse combination, or voice control. Preferably, the input device is a touchscreen. All functions of the measuring station 200 are controlled through the main control console 236 using instructions executable on a proprietary, custom programmed and manufactured microprocessor-based firmware, hardware and software that sets parameters for the measuring station 200, and when programmed, are maintained in a storage for use later on similar smokable products run through the measuring station 200 to speed production.

The customize software comprises instructions operable on a processor to control and/or adjust parameters of the measuring station 200 for various different smokable products, such as, for example, cone capacity, fill/tap tray, a position fill puck, the expanded aperture hoppers, coordinated with back feeders, to accommodate unique flow characteristics of smokable material, the high amplitude, pneumatic hopper vibrators for even product supply distribution, includes pneumatic control valves, air fittings, hopper modifications for mounting, etc., the feeder bowls for product singulation and flow control for accurate weighing with coordinating "top-off" lane gates, a plurality of input dip funneling assemblies prevent product loss as a result of spillage, a plurality of simultaneous dual cone filling positions for added speed, fully programmed with orienting, breeze shield to prevent disturbance from ambient disturbed air during operation, 360° access door as well as top loading access door that can be configured with lockout options, a specialized P.E.T., weigh bucket to achieve accuracy, provide stability and ensure highest possible resolution, high resolution weigh modules integrated with special custom analog to digital (A/D) hardware and custom programming to achieve unsurpassed and consistent prerolls, adjustable leveling feet to accommodate irregular facility floors.

For example, using the main control console 236, and operator can set the following parameters, assuming a custom high precision 500-gram weigh modules with 150% safe overload. Then assume a 250-gram dead load that includes the weigh bucket scoops 214 and 216 weigh bucket scoops 214 and 216 hardware. The maximum resolution of the system 100 with high precision standard controls would be 0.002% of 500 gram or 1/100 gram if great care is taken in regard to other combined load factors. However, actual accuracy as defined above, under normal operating conditions could not be guaranteed to be greater than 0.025 grams; i.e., +/−0.01 accuracy could be achieved but expect +/−0.02.

The measuring station 200 further comprises variable amplitude and frequency control in an enclosed space. Depending on the smokable product that is being prerolled, the amount and height of the frequency used to vibrate the smokable product from the vibratory bowls 210 and 212 into the weigh modules 218 and 220 will need to be varied. Additionally, these parameters will need to be adjusted for the size of the preroll cones and the speed that a user requires for the filling of the prerolls. Various types of smokable product can be used with the system 100 and all of these parameters are controlled using the main control console 236.

In this embodiment, a 24 vdc variable amplitude and frequency control is used to rapidly achieve a fast cycle time, then slow down to meter the smokable product more precisely as the net weight nears the target. The variable amplitude and frequency control also maintains consistent speeds, regardless of the head pressure of the smokable product.

The variable amplitude and frequency control is adjustable because ground smokable product consistency varies greatly. The variable amplitude and frequency control also control the vibratory bowls 210 and 212 is used to meter the ground smokable product in a controlled and predictable way. The vibratory bowls 210 and 212 is in turn fed by linear feeder pans 206 and 208 that is small, specially designed and mounted on the vibratory bowls 210 and 212, that is fed from custom designed hoppers 202 and 204 comprise special angles, screens and other innovations that allow the system 100 to adapt to the consistency of the smokable product. The linear feeder pans 206 and 208 and vibratory bowls 210 and 212 can be both mechanically and electronically adjusted for product consistency. In one embodiment, the linear feeder pans 206 and 208 is powered by proprietary digitally adjustable RC controls and the vibratory bowls 210 and 212 is powered by custom digitally adjustable 24 vdc variable amplitude and frequency-controlled devices. The vibratory bowls 210 and 212 rapidly flow the smokable product to weigh bucket scoops 214 and 216 mounted on the weigh modules 218 and 220, to achieve fast cycle time, then slow down to meter the smokable product more precisely as the net weight nears the target.

Using instructions executable on a processor in the main control console 236 the system 100 is capable of achieving a resolution of 0.01 grams, +/−0.02 grams accuracy. An analog output from the weigh modules 218 and 220 is converted from increments of 1/10,000th of a millivolt (mV), or one (1) millionth of a volt, 0.00000001 V into a digital equivalent number for use by the main control console 236. The weigh modules 218 and 220 is also fitted with a custom cover to reduce electrical interference to protect the weigh modules 218 and 220 from damage.

In one embodiment, the weigh modules 218 and 220 is a ceramic capacitance sensor that has a high resolution and easier to use in automation. The ceramic capacitance sensor works by measuring changes in capacitance. The net weight of the smokable product on the capacitance sensor changes the capacitance between the two conductors, and an electric field is created between them that is measured with a high degree of accuracy.

In another embodiment, the weigh modules 218 and 220 comprises a tuning fork type sensor. The tuning fork type sensor has a wire that is vibrated, under controlled conditions. When net weight is applied, and the vibration frequency is measured to accurately determine the net weight.

In another embodiment the weigh modules 218 and 220 use a weigh modules strain gauge. A 5-15 VDC input is sent through fine wires (strain gauges) precisely glued to various locations on body of the weigh modules 218 and 220 to compensate for side load, non-level conditions, etc. is used. The body of the weigh modules 218 and 220 bends, causing the fine wires to change conductivity and output a voltage in microvolts. This analog voltage is then measured to accurately determine the smokable product net weight, and, in some cases, converted and then digitized.

There is also provided a method for using the system 100, comprising the steps of first providing, a two-stage cone holding/tamping tray system 100.

First, the system 100 weighs and fills ground smokable product into "preroll" smoking cones, then compacts the smokable product to desired density, at the rate of 1500 cones per hour. The finished smoking cones contain a precise, regulatory compliant, +/−3% of labeled net weight. The flexible design allows the processing of products with diverse or difficult flow characteristics.

Because ground smokable product consistency varies greatly, the vibratory bowls 210 and 212 are used to meter the ground smokable product in a controlled and predictable way. The vibratory bowls 210 and 212 is in turn fed by small specially designed linear feeder pans 206 and 208 mounted on the vibratory bowls 210 and 212 from the hoppers 202 and 204 that is custom designed with special angles, screens and other innovations that allow the system 100 to adapt to the consistency of the smokable product. The linear feeder pans 206 and 208 and the vibratory bowls 210 and 212 can be both mechanically and electronically adjusted for product consistency. The linear feeder pans 206 and 208 is powered by proprietary digitally adjustable RC controls and the vibratory bowls 210 and 212 is powered by custom digitally adjustable 24 vdc variable amplitude and frequency-controlled devices. The vibratory bowls 210 and 212 rapidly flow the smokable product to weigh buckets mounted on net weight sensors, or weigh modules, to achieve fast cycle time, then slow down to meter the smokable product more precisely as the net weight nears the target.

To catch the correct net weight to 0.01 g resolution, +/−0.02 g accuracy the weigh modules analog output is read in increments of 1/10,000 millivolt (mv)—or one millionth of a volt. This highly specialized measurement device digitizes and registers tiny output changes in less than 10 milliseconds then makes decisions based on algorithms according to the my level. All functions including the vibratory bowl and vibratory feeder speeds are controlled instructions operable on one or more than one processor with custom firmware. The main controls comprise the custom based firmware, where the custom based firmware comprising instructions executable on the one or more than one processors, hardware, and software. The executable instructions set parameters that, once programmed, are maintained in a memory for use later for the same or similar products.

As the vibratory bowls feed the weigh buckets, stable target net weights are achieved. Then the verified weighed product is "ready" for discharge into cavities in the filling puck. The filling puck is mounted on a high precision servo driven XY orienter. Once the filling puck is in one of 120 predetermined positions, within +/−0.1 mm, the weighed product is emptied into the filling puck at that position. The size, angles and specialty materials of the filling puck and cavities are custom designed and machined in such a way that the smokable product can later be vibrated into the tamping station 600 with no loss, bridging, clogging or accrual of product.

Figure 42:
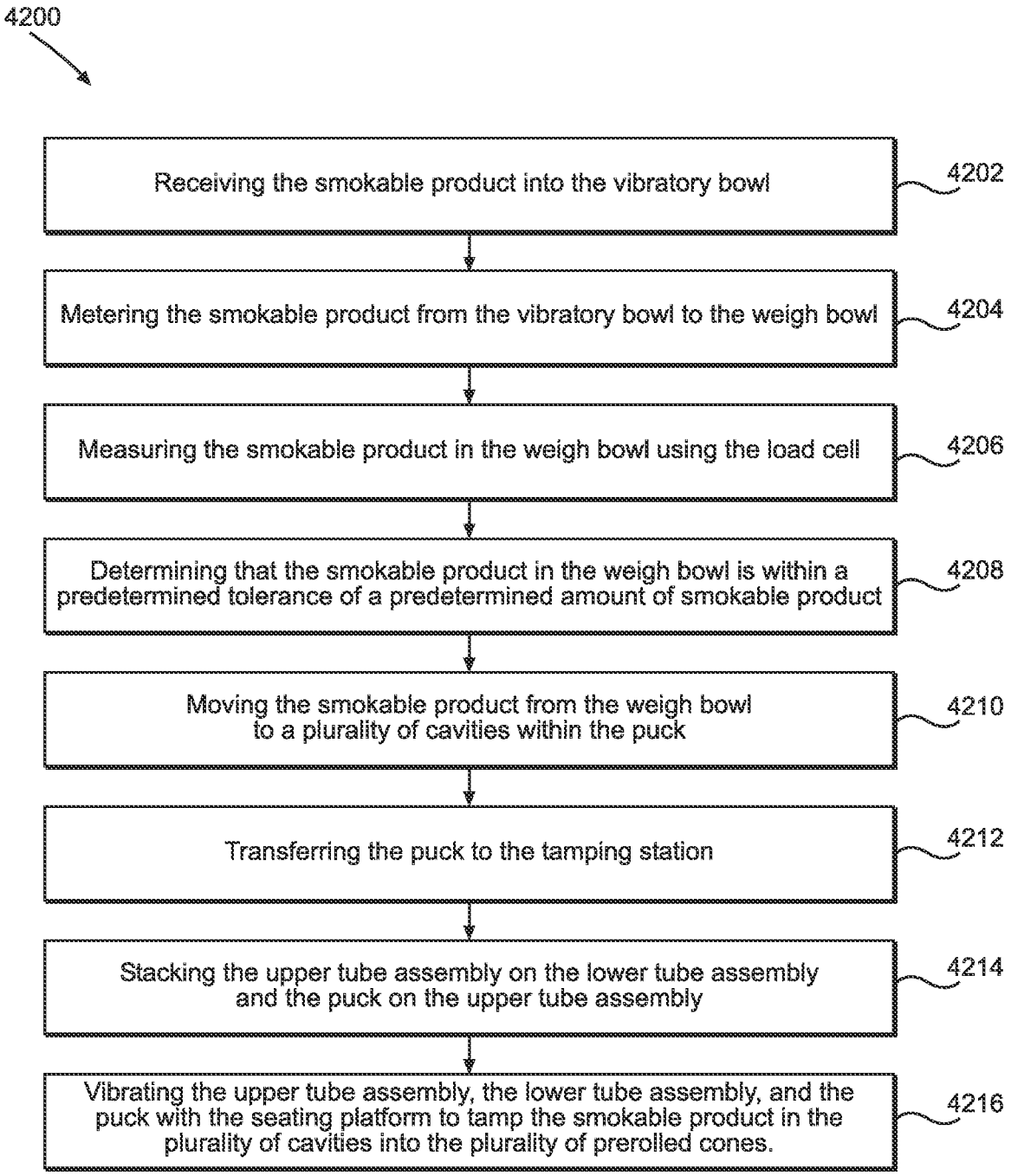
FIG. 42 illustrates a flow diagram of a method of manufacturing a plurality of prerolled cones containing a smokable product using a measuring station and a tamping station in accordance with aspects of the current disclosure.

FIG. 42 is a flow chart of a method 4200 of a method of manufacturing a plurality of prerolled cones containing a smokable product using a measuring station and a tamping station. The measuring station includes a vibratory bowl, a weigh bowl, a weigh module, and a puck. The tamping station includes an upper tube assembly including a plurality of tight tubes for containing the plurality of prerolled cones, a lower tube assembly including a plurality of loose tubes for containing the plurality of prerolled cones, and a seating platform. The method 4200 includes receiving 4202 the smokable product into the vibratory bowl. The method 4200 also includes metering 4204 the smokable product from the vibratory bowl to the weigh bowl. The method 4200 further includes measuring 4206 the smokable product in the weigh bowl using the weigh modules. The method 4200 also includes determining 4208 that the smokable product in the weigh bowl is within a predetermined tolerance of a predetermined amount of smokable product. The method 4200 further includes moving 4210 the smokable product from the weigh bowl to a plurality of cavities within the puck. The method 4200 also includes transferring 4212 the puck to the tamping station. The method 4200 further includes stacking 4214 the upper tube assembly on the lower tube assembly and the puck on the upper tube assembly. The method 4200 also includes vibrating 4216 the upper tube assembly, the lower tube assembly, and the puck with the seating platform to tamp the smokable product in the plurality of cavities into the plurality of prerolled cones.

What has been described is a new and improved system for an accurate net weight based rolling system producing prerolls that are compliant, consistent, repeatable, and scalable for automatic cone filling, overcoming the limitations and disadvantages inherent in the related art.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. A rolling system comprising:

a measuring station comprising:

a hopper for receiving a smokable product;

a vibratory bowl for receiving the smokable product from the hopper;

a weigh bowl for receiving the smokable product from the vibratory bowl;

a load cell attached to the weigh bowl for measuring the smokable product in the weigh bowl; and a puck defining a plurality of cavities for receiving the smokable product therein, wherein each cavity of the plurality of cavities is configured to receive a predetermined amount of smokable product within a predetermined tolerance of the predetermined amount wherein the puck includes a puck body defining the plurality of cavities, wherein the plurality of cavities are arranged in a plurality of rows within the puck body to define a grid pattern.

2. The rolling system of claim 1, further comprising a feeder configured to receive the smokable product from the weigh bowl and feed the smokable product to the plurality of cavities of the puck.

3. The rolling system of claim 2, wherein the feeder comprises a vertical channel and a cone.

4. The rolling system of claim 3, further comprising an X-axis orienter attached to the puck and configured to move the puck and the cavities underneath the cone.

5. The rolling system of claim 4, further comprising a Y-axis orienter attached to the puck and configured to move the puck and the cavities underneath the cone.

6. The rolling system of claim 5, wherein the X-axis orienter is attached to the Y-axis orienter.

7. The rolling system of claim 1, further comprising a linear feeder pan configured to receive the smokable product from the hopper and feed the smokable product to the vibratory bowl.

8. The rolling system of claim 1, wherein the hopper includes a V-shaped container including sides defining an angle relative to a horizon.

9. The rolling system of claim 8, wherein the angle is about 70° to about 75°.

10. The rolling system of claim 8, wherein the hopper further comprises a screen.

11. The rolling system of claim 8, wherein the hopper further comprises a gate.

12. The rolling system of claim 1, wherein the vibratory bowl comprises a bowl and a sweep positioned within the bowl.

13. The rolling system of claim 12, wherein the sweep rotates within the bowl.

14. The rolling system of claim 12, wherein the vibratory bowl further comprises a channel configured to receive the smokable product from the sweep and configured to feed the smokable product to the weigh bowl.

15. The rolling system of claim 1, further comprising a tamping station comprising:

an upper tube assembly comprising a plurality of first tubes for containing a plurality of prerolled cones;

a lower tube assembly comprising a plurality of second tubes for containing the plurality of prerolled cones; and a seating platform for vibrating the puck, the upper tube assembly, and the lower tube assembly, wherein the upper tube assembly is stacked on the lower tube assembly and the puck is stacked on the upper tube assembly.

16. The rolling system of claim 15, wherein the tamping station further comprises an air nozzle for seating the plurality of prerolled cones in the upper tube assembly.

17. The rolling system of claim 15, wherein the tamping station further comprises a pneumatic piston configured to vibrate the puck, the upper tube assembly, and the lower tube assembly.

18. The rolling system of claim 15, wherein the tamping station further comprises a first air cylinder attached to the seating platform and configured to vibrate the seating platform.

19. The rolling system of claim 18, wherein the tamping station further comprises a second air cylinder attached to the seating platform and configured to vibrate the seating platform.

20. The rolling system of claim 1, wherein the puck body comprises an acetal plastic.

21. The rolling system of claim 1, wherein the predetermined tolerance is within ±3% of the predetermined weight.

* * * * *